US012680743B2

(12) United States Patent
Cline et al.

(10) Patent No.: US 12,680,743 B2
(45) Date of Patent: Jul. 14, 2026

(54) THERMAL SYSTEM HAVING HYDRONIC SYSTEM HEAT EXCHANGE

(71) Applicant: TRANE INTERNATIONAL INC., Davidson, NC (US)

(72) Inventors: Lee R. Cline, West Salem, WI (US); Ronald Maurice Cosby, II, La Crosse, WI (US); Brian J Fiegen, La Crosse, WI (US); Changiz Mirza-Tolouee, Marietta, GA (US)

(73) Assignee: TRANE INTERNATIONAL INC., Davidson, NC (US)

( * ) Notice: Subject to any disclaimer, the term of this patent is extended or adjusted under 35 U.S.C. 154(b) by 253 days.

(21) Appl. No.: 18/333,901

(22) Filed: Jun. 13, 2023

(65) Prior Publication Data

US 2024/0418422 A1 Dec. 19, 2024

(51) Int. Cl.

| | |
|---|---|
| ***F25B 47/02*** | (2006.01) |
| ***F25B 7/00*** | (2006.01) |
| ***F25B 41/20*** | (2021.01) |

(52) U.S. Cl.

CPC ..... *F25B 47/02* (2013.01); *F25B 7/00* (2013.01); *F25B 41/20* (2021.01)

(58) Field of Classification Search

CPC .. F25B 7/00; F25B 41/20; F25B 13/00; F25B 2339/047; F25B 25/005; F25B 41/40; F25B 49/02; F25B 47/02; F24D 3/18; F24D 19/1039; F24D 21/12; F24F 3/001; F24F 11/42; F24H 15/136

See application file for complete search history.

(56) References Cited

U.S. PATENT DOCUMENTS

| | | | | |
|---|---|---|---|---|
| 4,972,679 | A * | 11/1990 | Petty | C09K 5/047 62/476 |
| 5,269,151 | A | 12/1993 | Dinh | |
| 6,615,602 | B2 | 9/2003 | Wilkinson | |
| 7,827,817 | B2 | 11/2010 | Inoue et al. | |
| 8,245,948 | B2 | 8/2012 | Cho et al. | |
| 10,302,343 | B2 | 5/2019 | Yoshikawa et al. | |
| 10,317,112 | B2 | 6/2019 | Kopko | |

(Continued)

FOREIGN PATENT DOCUMENTS

| | | |
|---|---|---|
| CN | 200955881 | 10/2007 |
| CN | 203454505 | 2/2014 |

(Continued)

OTHER PUBLICATIONS

Extended European Search Report, European Patent Application No. 24181674.3, Oct. 23, 2024 (10 pages).

*Primary Examiner* — Kun Kai Ma
(74) *Attorney, Agent, or Firm* — HSML P.C.

(57) ABSTRACT

Process fluid from a hydronic system can be directed to an air-to-fluid heat exchanger in a heat exchange relationship with an outdoor heat exchanger of a thermal system connected to the hydronic system. The flow from the hydronic system to the air-to-fluid heat exchanger can be controlled using one or more valves. The process fluid at the air-to-fluid heat exchanger can defrost the outdoor heat exchanger, be used for free heating or cooling by being directed to a secondary load, or be used for balancing of cascade systems. A reversible fan can be provided at the outdoor heat exchanger and the air-to-fluid heat exchanger to facilitate these operations.

20 Claims, 9 Drawing Sheets

(56) References Cited

U.S. PATENT DOCUMENTS

| | | | |
|---|---|---|---|
| 10,495,358 | B2 | 12/2019 | Cline et al. |
| 10,508,826 | B2 | 12/2019 | Takenaka et al. |
| 2007/0137238 | A1 | 6/2007 | Hu |
| 2009/0223232 | A1 | 9/2009 | Rolfsman et al. |
| 2011/0011104 | A1 | 1/2011 | Lesage et al. |
| 2014/0260361 | A1 | 9/2014 | Rodier |
| 2017/0184314 | A1 | 6/2017 | Ogata et al. |
| 2019/0285318 | A1 | 9/2019 | Kopko |
| 2021/0156601 | A1 | 5/2021 | Melink et al. |
| 2022/0252326 | A1 | 8/2022 | Jing et al. |
| 2023/0101537 | A1 | 3/2023 | Lee et al. |

FOREIGN PATENT DOCUMENTS

| | | | | | |
|---|---|---|---|---|---|
| CN | 105764727 | A | * | 7/2016 | ..... B60H 1/32281 |
| CN | 106660430 | A | * | 5/2017 | ..... F25B 27/02 |
| CN | 106766382 | A | * | 5/2017 | ..... F25B 30/06 |
| CN | 111391616 | A | * | 7/2020 | ..... B60H 1/00392 |
| CN | 215490453 | | | 1/2022 | |
| CN | 215930175 | U | * | 3/2022 | ..... F25B 13/00 |
| CN | 114636224 | A | | 6/2022 | |
| CN | 110160171 | B | * | 4/2024 | ..... F24F 3/065 |
| EP | 2048451 | A1 | | 4/2009 | |
| GB | 2563511 | A | | 12/2018 | |
| JP | 2007069733 | A | * | 3/2007 | ..... B60H 1/00914 |
| JP | 2013119954 | A | * | 6/2013 | |
| KR | 20140146779 | A | | 12/2014 | |
| KR | 102021653 | B1 | | 9/2019 | |
| WO | WO-2023051746 | A1 | * | 4/2023 | |

* cited by examiner

THERMAL SYSTEM HAVING HYDRONIC SYSTEM HEAT EXCHANGE

FIELD

This disclosure is directed to heating, ventilation, air conditioning, and refrigeration (HVACR) systems including a thermal system circuit and a hydronic system, where the hydronic system can exchange heat with an outdoor heat exchanger of the thermal system circuit.

BACKGROUND

At some ambient conditions, thermal systems can experience a buildup of ice on an outdoor heat exchanger. The ice buildup can be removed by operating in a defrost mode, where hot working fluid is directed to the outdoor heat exchanger to melt the ice. This requires operation in a specific mode and can disrupt heating operations of the thermal system and reduce heating efficiency. Additionally, cascade thermal system systems can experience imbalances in the heat generation of the system, causing one or both of the thermal systems in the cascade arrangement to be operated at less efficient operational conditions.

SUMMARY

This disclosure is directed to heating, ventilation, air conditioning, and refrigeration (HVACR) systems including a thermal system circuit and a hydronic system, where the hydronic system can exchange heat with an outdoor heat exchanger of the thermal system circuit.

By allowing heat exchange between the hydronic system and one or more outdoor heat exchangers of a thermal system circuit, various functionalities can be provided with no or reduced impact on the operation of the thermal system circuit. The functionalities can include, for example, defrosting of the one or more outdoor heat exchangers, capturing heating or cooling to enable simultaneous servicing of heating and cooling modes, pre-heating or pre-cooling of fluid in the hydronic system, and/or supporting cascade operations to boost capacity. In some embodiments, the fluid of the hydronic system exchanges heat at the one or more outdoor heat exchangers can be selectively obtained from or returned to either of the return line or the supply line, further enhancing control of these capabilities. Selectively sourcing and/or returning fluid from either the return line or the supply line can enable some functionalities and/or improve response to various conditions including but not limited to operating modes, heating and cooling demands, ambient conditions, combinations and/or relationships thereof, and the like.

In an embodiment, a method includes directing a portion of a flow of process fluid from a hydronic system to a heat exchanger, the heat exchanger configured to exchange heat between the process fluid and an outdoor heat exchanger of a working fluid circuit of a thermal system.

In an embodiment, the process fluid rejects heat to the outdoor heat exchanger. In an embodiment, the method further includes determining a defrosting operation of the heat exchanger, and where the directing the portion of the flow of process fluid from the hydronic system to the heat exchanger is performed when the defrosting operation is determined. In an embodiment, the flow of process fluid, after leaving the heat exchanger, is directed to a cooling load of the hydronic system.

In an embodiment, the process fluid absorbs heat from the outdoor heat exchanger. In an embodiment, the flow of process fluid, after leaving the heat exchanger, is directed to a heating load of the hydronic system.

In an embodiment, the process fluid is circulated between the thermal system and a second thermal system in a cascade system, and the process fluid rejects heat to the outdoor heat exchanger such that the process fluid is provided to the second thermal system at a target temperature.

In an embodiment, the thermal system is selected from the group consisting of a heat pump, a chiller, and a combined heating and cooling apparatus.

In an embodiment, a thermal system and hydronic system includes a thermal system configured to circulate a working fluid. The thermal system includes a compressor, a flow reverser, a first heat exchanger configured to exchange heat between the working fluid and an ambient environment, an expander, and a second heat exchanger configured to exchange heat between the working fluid and a process fluid. A hydronic system is configured to circulate the process fluid, The hydronic system includes a supply line configured to convey the process fluid from the second heat exchanger to a load, a return line configured to convey the process fluid from the load to the second heat exchanger, an air-to-fluid heat exchanger configured to exchange heat between the process fluid and the ambient environment at the first heat exchanger, and one or more valves configured to regulate flow of the process fluid to the air-to-fluid heat exchanger.

In an embodiment, the thermal system and hydronic system further includes a secondary load supply line configured to convey the process fluid from the air-to-fluid heat exchanger to a secondary load, a secondary load return line configured to convey the process fluid from the secondary load to the air-to-fluid heat exchanger, one or more valves configured to regulate flow of the process fluid from the air-to-fluid heat exchanger to the secondary load supply line, and one or more valves configured to regulate flow of the process fluid from the secondary load return line to the air-to-fluid heat exchanger. In an embodiment, the secondary load is a cooling load. In an embodiment, the secondary load is a heating load.

In an embodiment, the load is a second thermal system, the second thermal system in a cascade relationship with the first thermal system. In an embodiment, the thermal system and hydronic system further includes a controller configured to determine operation in a defrost mode, and to control at least one of the one or more valves to allow flow of the process fluid to the air-to-fluid heat exchanger.

In an embodiment, the thermal system and hydronic system further includes a fan configured to direct airflow over the first heat exchanger and the air-to-fluid heat exchanger. In an embodiment, the fan is reversible.

In an embodiment, the thermal system further includes a third heat exchanger, the third heat exchanger configured to exchange heat between the working fluid and a second process fluid of a second hydronic system, the second hydronic system configured to circulate the second process fluid to a second load. In an embodiment, the second hydronic system is configured to selectively provide the second process fluid to the air-to-fluid heat exchanger. In an embodiment, the thermal system and hydronic system further includes at least one second air-to-fluid heat exchanger, wherein the second hydronic system is configured to selectively provide the second process fluid to the least one second air-to-fluid heat exchanger. In an embodiment, one of the load and the second load is a heating load, and the other of the load and the second load is a cooling load.

DRAWINGS

DETAILED DESCRIPTION

This disclosure is directed to heating, ventilation, air conditioning, and refrigeration (HVACR) systems including a thermal system circuit and a hydronic system, where a hydronic system can exchange heat with outdoor heat exchanger of the thermal system.

As used herein, "hydronic system" refers to any system that circulates any suitable process fluid to convey heat from one or more heat sources to one or more heat sinks. Process fluids that can be used in hydronic systems as discussed herein include, but are not limited to water, glycol, blends thereof, and the like.

Figure 1:
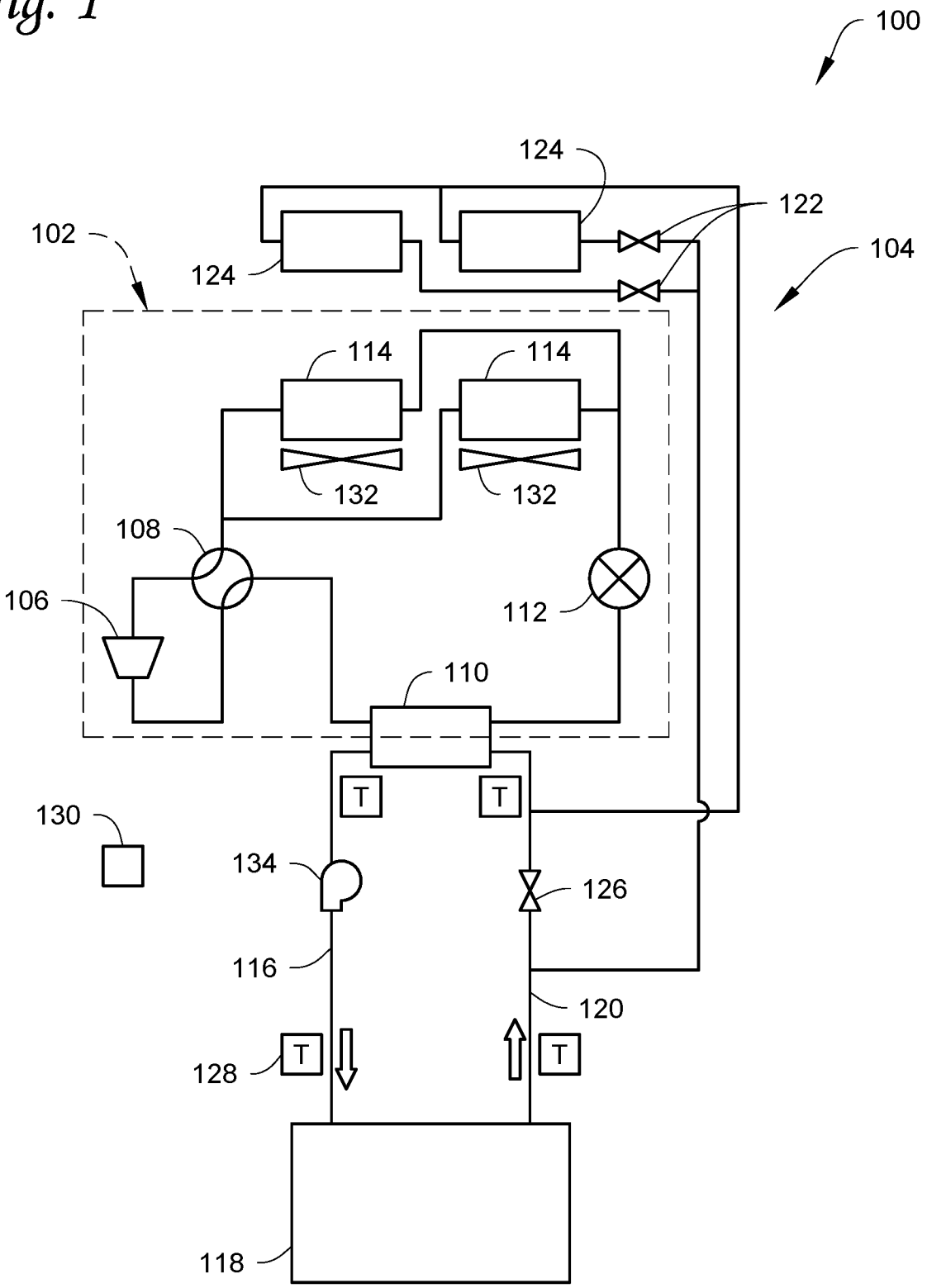
FIG. 1 shows a schematic of a thermal system and a hydronic system according to an embodiment.

FIG. 1 shows a schematic of a thermal system and a hydronic system according to an embodiment. Thermal system and hydronic system 100 includes thermal system 102 and hydronic system 104. Thermal system 102 includes a compressor 106, a flow reverser 108, a first heat exchanger 110, an expander 112, and one or more second heat exchangers 114. The hydronic system 104 includes the first heat exchanger 110, a supply line 116 from the first heat exchanger 110 to a load 118, a return line 120 from the load 118 to the first heat exchanger 110. The hydronic system 104 further includes controllable valves 122, air-to-fluid heat exchangers 124, and bypass valve 126. Hydronic system 104 can further include temperature sensors 128 and controller 130. Thermal system and hydronic system 100 can also include fans 132. Pump 134 can be included in the hydronic system 104.

Thermal system and hydronic system 100 is configured such that thermal system 102 is operated to add or remove heat from a process fluid circulated within hydronic system 104. In embodiments, the thermal system 102 can be a heat pump, a chiller, a combined heating and cooling system such as a multi-pipe heating and cooling system, or the like. The process fluid can exchange heat with load 118 so as to service heating and/or cooling needs at the load 118.

Thermal system 102 is configured to circulate a working fluid so as to add or remove heat from the process fluid. In the embodiment shown in FIG. 1, thermal system 102 is a reversible heat pump. In other embodiments, thermal system 102 can instead be any other suitable thermal system for heating or cooling a process fluid by way of circulation of a working fluid. Thermal system 102 includes a compressor 106. Compressor 106 can be any suitable compressor for compressing the working fluid. In an embodiment, multiple compressors 106 can be provided as the compressor 106 as shown in FIG. 1. Compressed working fluid discharged from the compressor 106 is then directed to flow reverser 108. Flow reverser 108 is a flow control configured to control a direction of flow through the thermal system 102 by directing the discharge from the compressor 106 to either first heat exchanger 110 or the one or more second heat exchangers 114. In the heating mode, the flow reverser 108 directs the discharge of the compressor 106 to first heat exchanger 110, and directs working fluid received from the one or more second heat exchangers 114 to the compressor 106. In the cooling mode, the flow reverser 108 directs the discharge of the compressor 106 to the one or more second heat exchangers 114, and directs working fluid received from the first heat exchanger to the compressor 106.

The first heat exchanger 110 is a heat exchanger configured to exchange heat between the working fluid and process fluid being circulated through the hydronic system 104. In the heating mode, the first heat exchanger 110 operates as a condenser for the working fluid, where the working fluid rejects heat, thus heating the process fluid in the hydronic system 104. In the cooling mode, the first heat exchanger 110 operates as an evaporator, with the working fluid absorbing heat, thereby cooling the process fluid.

An expander 112 is provided between the first heat exchanger 110 and the one or more second heat exchangers 114. The expander 112 can be any suitable expander capable of expanding received working fluid, such as, for example, an expansion valve, an expansion plate, an expansion vessel, one or more expansion orifices, or any other known suitable structure for expanding the working fluid. In an embodiment, the expander 112 is an electronic expansion valve.

Thermal system 102 further includes one or more second heat exchangers 114. The second heat exchanger(s) 110 are heat exchangers configured to exchange heat with an ambient environment or other suitable source/sink for heat. In an embodiment, the one or more second heat exchangers 114 are outdoor heat exchangers configured to exchange heat with air in the ambient environment of thermal system 102. In an embodiment, frost can build up on at least one of the one or more second heat exchangers 114 based on the ambient temperature and operations of the thermal system 102, for example when the thermal system 102 is being operated to provide heating at ambient temperatures below freezing. In the heating mode, the one or more second heat exchangers 114 operate as an evaporator, with the working fluid absorbing heat from the ambient environment. In the cooling mode, the one or more second heat exchangers 114 operate as a condenser for the working fluid, where the working fluid rejects heat to the ambient environment.

Hydronic system 104 is configured to circulate the process fluid from the first heat exchanger 110, where the process fluid absorbs or rejects heat according to the operating mode of thermal system 102, and load 118, where the process fluid exchanges heat to provide heating or cooling to service the load 118. In hydronic system 104, the process fluid can be driven to circulate by operation of a pump 134 in some examples. In an embodiment, the pump 134 can be provided at a different position in the hydronic system 104. In an embodiment, multiple pumps 134 can be provided to circulate the process fluid in hydronic system 104. Hydronic system 104 includes the process fluid side of first heat exchanger 110, at which the process fluid absorbs heat from or rejects heat to the working fluid of thermal system 102. Hydronic system 104 includes a supply line 116 from the first heat exchanger 110 to the load 118, which conveys the process fluid to the load 118. In an embodiment, the pump 134 is disposed along the supply line 116. The load 118 can be any suitable heating and/or cooling load to be serviced by operation of thermal system and hydronic system 100. The load 218 can be, as non-limiting examples, a heating and/or cooling load of a conditioned space, a heat exchanger of another thermal system in a cascade arrangement with the thermal system and hydronic system 100, or the like. Process fluid is returned from the load 118 by way of return line 120.

Controllable valves 122 are provided to regulate flow of process fluid from the return line 120 to each of the air-to-fluid heat exchangers 124. Controllable valves 122 can be any suitable valves capable of providing a variable flow or preventing flow into the corresponding air-to-fluid heat exchanger 124. One controllable valve 122 can be provided for each of the air-to-fluid heat exchangers 124.

The air-to-fluid heat exchangers 124 are one or more heat exchangers provided in proximity to the one or more second heat exchangers 114. In an embodiment, the air-to-fluid heat exchanger 124 and the corresponding second heat exchanger 114 can be provided in a single multi-function heat exchange structure. In an embodiment, one air-to-fluid heat exchanger 124 is provided for each of the one or more second heat exchangers 114. The air-to-fluid heat exchangers 124 can be in heat exchange relationships with the one or more second heat exchangers 114, either directly by having a portion in contact with the corresponding one or more second heat exchangers 114, or indirectly by way of the air at the air-to-fluid heat exchanger 124 and corresponding second heat exchanger 114, such as an airflow being driven by a corresponding fan 132. The process fluid can absorb or reject heat at the air-to-fluid heat exchangers 124, based on the ambient conditions and/or the temperature at the second heat exchanger 114. In an embodiment, the process fluid can reject heat at the air-to-fluid heat exchanger 124 such that the heat is at least partially absorbed by frost buildup on the corresponding second heat exchanger 114, thereby melting the frost buildup and defrosting the second heat exchanger 114.

A bypass valve 126 is provided along the return line 120. The bypass valve 126 can regulate flow that passes through return line 120 without passing to the controllable valves 122 and thus bypasses the air-to-fluid heat exchangers 124.

Temperature sensors 128 can be provided in hydronic system 104. The temperature sensors 128 can be positioned to measure suitable temperatures for control of the hydronic system 104, for example a supply temperature in supply line 116, a return temperature in return line 120, a thermal system entering temperature at an inlet of the process fluid side of first heat exchanger 110, and/or a thermal system leaving temperature at an outlet of the process fluid side of the first heat exchanger 110. The thermal system and hydronic system 100 can include a controller 130. In an embodiment, the controller 130 is configured to control the controllable valves 122 and bypass valve 126. The controller 130 can be configured to control the controllable valves 122 and bypass valve 126 based on, for example, a call to perform a defrosting operation, to achieve particular target values for a least one of the temperatures measured by the temperature sensors 128, or any other suitable basis for controlling the controllable valves 122 and bypass valve 126.

Fans 132 can be provided at or near each of the one or more second heat exchangers 114 and corresponding air-to-fluid heat exchangers 124. In an embodiment, the fans 132 can be controllable fans having variable speed. In an embodiment, the fans 132 can be reversible such that air can be pulled through or pushed into the second heat exchanger 114 and corresponding air-to-fluid heat exchanger 124. In an embodiment, the reversibility of the fan 132 can allow either of second heat exchanger 114 or air-to-fluid heat exchanger 124 to be the first of the respective heat exchangers 114, 124, that first receives the ambient air being driven or drawn by the fan 132.

Figure 2:
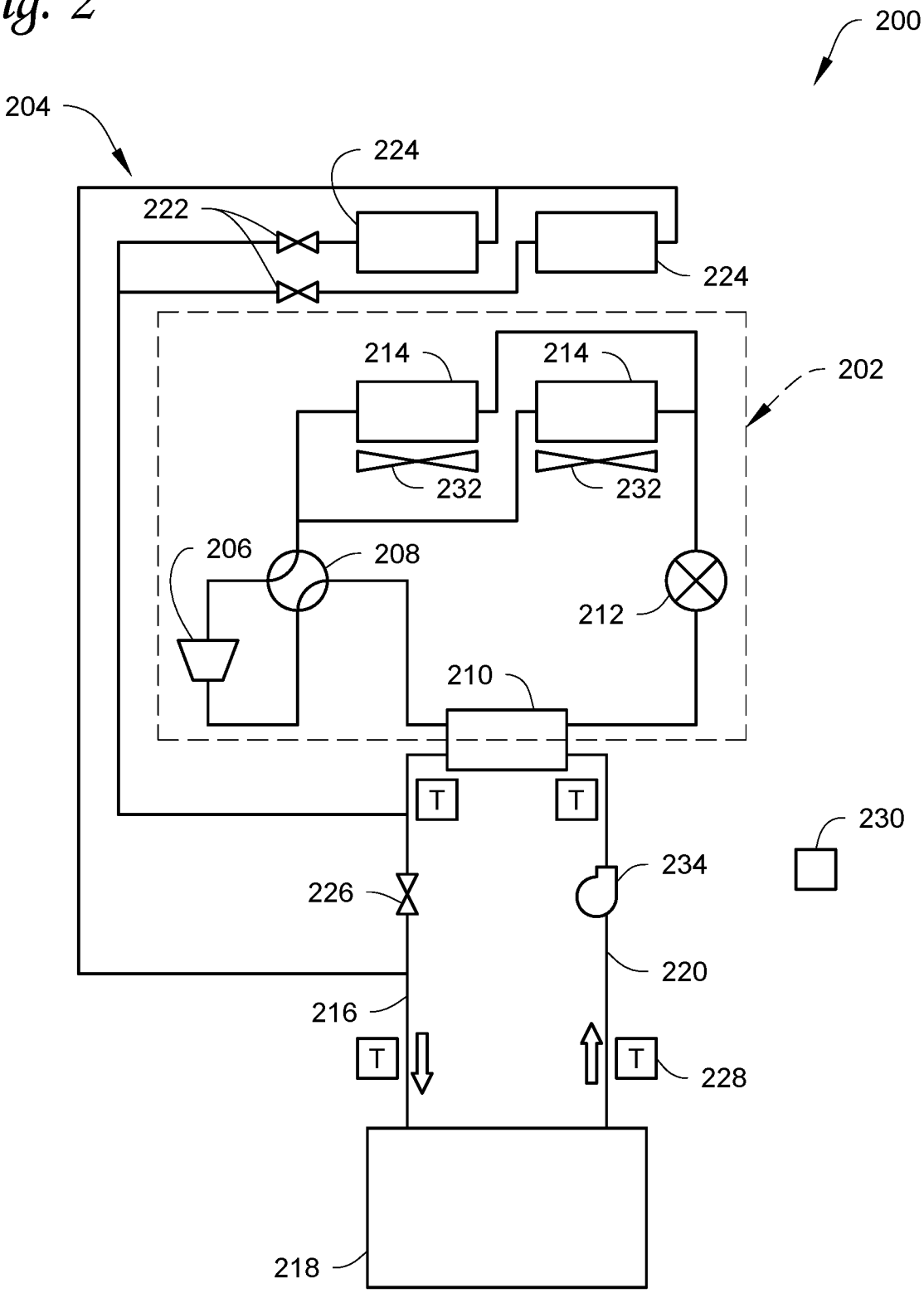
FIG. 2 shows a schematic of a thermal system and a hydronic system according to an embodiment.

FIG. 2 shows a schematic of a thermal system and a hydronic system according to an embodiment. Thermal system and hydronic system 200 includes thermal system 202 and hydronic system 204. Thermal system 202 includes a compressor 206, a flow reverser 208, first heat exchanger 210, an expander 212, and one or more second heat exchanger(s) 214. The hydronic system 204 includes the first heat exchanger 210, a supply line 216 from the first heat exchanger 210 to a load 218, a return line 220 from the load 218 to the first heat exchanger 210. The hydronic system 204 further includes controllable valves 222, air-to-fluid heat exchangers 224, and bypass valve 226. Hydronic system 204 can further include temperature sensors 228 and controller 230. Thermal system and hydronic system 200 can also include fans 232. Pump 234 can be included in the hydronic system 204.

Thermal system and hydronic system 200 is configured such that thermal system 202 is operated to add or remove heat from a process fluid circulated within hydronic system 204. The process fluid can exchange heat with load 218 so as to service heating and/or cooling needs at the load 218.

Thermal system 202 is a reversible thermal system configured to circulate a working fluid so as to add or remove heat from the process fluid. Thermal system 202 includes a compressor 206. Compressor 206 can be any suitable compressor for compressing the working fluid. In an embodiment, multiple compressors 206 can be provided as the compressor 206 as shown in FIG. 2. Compressed working fluid discharged from the compressor 206 is then directed to flow reverser 208. Flow reverser 208 is a flow control configured to control a direction of flow through the thermal system 202 by directing the discharge from the compressor 206 to either first heat exchanger 220 or the one or more second heat exchangers 214. In the heating mode, the flow reverser 208 directs the discharge of the compressor 206 to first heat exchanger 210, and directs working fluid received from the one or more second heat exchangers 214 to the compressor 206. In the cooling mode, the flow reverser 208 directs the discharge of the compressor 206 to the one or more second heat exchangers 214, and directs working fluid received from the first heat exchanger to the compressor 206.

The first heat exchanger 210 is a heat exchanger configured to exchange heat between the working fluid and process fluid being circulated through the hydronic system 204. In the heating mode, the first heat exchanger 210 operates as a condenser for the working fluid, where the working fluid rejects heat, thus heating the process fluid in the hydronic system 204. In the cooling mode, the first heat exchanger 210 operates as an evaporator, with the working fluid absorbing heat, thereby cooling the process fluid.

An expander 212 is provided between the first heat exchanger 210 and the one or more second heat exchangers 214. The expander 212 can be any suitable expander capable of expanding received working fluid, such as, for example, an expansion valve, an expansion plate, an expansion vessel, one or more expansion orifices, or any other known suitable structure for expanding the working fluid. In an embodiment, the expander 212 is an electronic expansion valve.

Thermal system 202 further includes one or more second heat exchangers 214. The second heat exchanger(s) 214 are heat exchangers configured to exchange heat with an ambient environment or other suitable source/sink for heat. In an embodiment, the one or more second heat exchangers 214 are outdoor heat exchangers configured to exchange heat with air in the ambient environment of thermal system 202. In an embodiment, frost can build up on at least one of the one or more second heat exchangers 214 based on the ambient temperature and operations of the thermal system 202, for example when the thermal system is being operated to provide heating at ambient temperatures below freezing. In the heating mode, the one or more second heat exchangers 214 operate as an evaporator, with the working fluid absorbing heat from the ambient environment. In the cooling mode, the one or more second heat exchangers 214 operate as a condenser for the working fluid, where the working fluid rejects heat to the ambient environment.

Hydronic system 204 is configured to circulate the process fluid from the first heat exchanger 210, where the process fluid absorbs or rejects heat according to the operating mode of thermal system 202, and load 218, where the process fluid exchanges heat to provide heating or cooling to service the load 218. In hydronic system 204, the process fluid can be driven to circulate by operation of a pump 234 in some examples. In an embodiment, the pump 234 can be provided at a different position in the hydronic system 204. In an embodiment, multiple pumps 234 can be provided to circulate the process fluid in hydronic system 204. Hydronic system 204 includes the process fluid side of first heat exchanger 210, at which the process fluid absorbs heat from or rejects heat to the working fluid of thermal system 202. Hydronic system 204 includes a supply line 216 from the first heat exchanger 210 to the load 218, which conveys the process fluid to the load 218. In an embodiment, the pump 234 is disposed along the supply line 216. The load 218 can be any suitable heating and/or cooling load to be serviced by operation of thermal system and hydronic system 200. The load 218 can be, as non-limiting examples, a heating and/or cooling load of a conditioned space, a heat exchanger of another thermal system in a cascade arrangement with the thermal system and hydronic system 200, or the like. Process fluid is returned from the load 218 by way of return line 220.

Controllable valves 222 are provided to regulate flow of process fluid from the supply line 216 to each of the air-to-fluid heat exchangers 224. Controllable valves 222 can be any suitable valves capable of providing a variable flow or preventing flow into the corresponding air-to-fluid heat exchanger 224. One controllable valve 222 can be provided for each of the air-to-fluid heat exchangers 224.

The air-to-fluid heat exchangers 224 are one or more heat exchangers provided in proximity to the one or more second heat exchangers 214. In an embodiment, the air-to-fluid heat exchanger 224 and the corresponding second heat exchanger 214 can be provided in a single multi-function heat exchange structure. In an embodiment, one air-to-fluid heat exchanger 224 is provided for each of the one or more second heat exchangers 214. The air-to-fluid heat exchangers 224 can be in heat exchange relationships with the one or more second heat exchangers 214, either directly by having a portion in contact with the corresponding one or more second heat exchangers 214, or indirectly by way of the air at the air-to-fluid heat exchanger 224 and corresponding second heat exchanger 214, such as an airflow being driven by a corresponding fan 232. The process fluid can absorb or reject heat at the air-to-fluid heat exchangers 224, based on the ambient conditions and/or the temperature at the second heat exchanger 214. In an embodiment, the process fluid can reject heat at the air-to-fluid heat exchanger 224 such that the heat is at least partially absorbed by frost buildup on the corresponding second heat exchanger 214, thereby melting the frost buildup and defrosting the second heat exchanger 214.

A bypass valve 226 is provided along the supply line 216. The bypass valve 226 can regulate flow that passes through supply line 216 without passing to the controllable valves 222 and thus bypasses the air-to-fluid heat exchangers 224.

Temperature sensors 228 can be provided in hydronic system 204. The temperature sensors 228 can be positioned to measure suitable temperatures for control of the hydronic system 204, for example a supply temperature in supply line 216, a return temperature in return line 220, a thermal system entering temperature at an inlet of the process fluid side of first heat exchanger 210, and/or a thermal system leaving temperature at an outlet of the process fluid side of the first heat exchanger 210. The thermal system and hydronic system 200 can include a controller 230. In an embodiment, the controller 230 is configured to control the controllable valves 222 and bypass valve 226. The controller 230 can be configured to control the controllable valves 222 and bypass valve 226 based on, for example, a call to perform a defrosting operation, to achieve particular target values for a least one of the temperatures measured by the temperature sensors 228, or any other suitable basis for controlling the controllable valves 222 and bypass valve 226.

Fans 232 can be provided at the one or more second heat exchangers 214 and the corresponding air-to-fluid heat exchangers 224. In an embodiment, the fans 232 can be controllable fans having variable speed. In an embodiment, the fans 232 can be reversible such that air can be pulled through or pushed into the second heat exchanger 214 and air-to-fluid heat exchanger 224. In an embodiment, the reversibility of the fan 232 can allow either of second heat exchanger 214 or air-to-fluid heat exchanger 224 to be the first of the respective heat exchangers 214, 224, that first receives the ambient air being driven or drawn by the fan 232.

Figure 3:
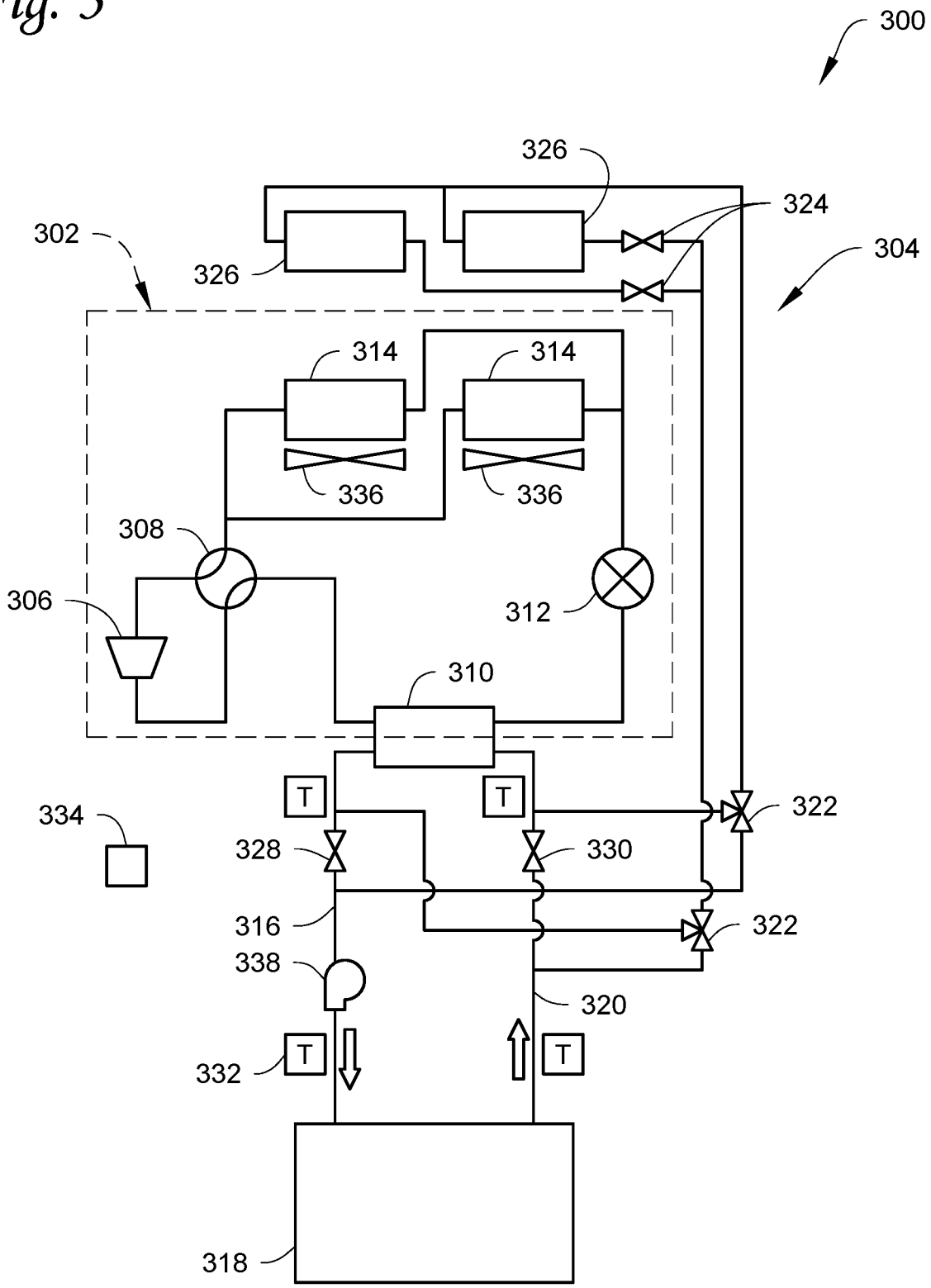
FIG. 3 shows a schematic of a thermal system and a hydronic system according to an embodiment.

FIG. 3 shows a schematic of a thermal system and a hydronic system according to an embodiment. Thermal system and hydronic system 300 includes thermal system 302 and hydronic system 304. Thermal system 302 includes a compressor 306, a flow reverser 308, a first heat exchanger 310, an expander 312, and one or more second heat exchanger(s) 314. The hydronic system 304 includes the first heat exchanger 310, a supply line 316 from the first heat exchanger 310 to a load 318, a return line 320 from the load 318 to the first heat exchanger 310. The hydronic system 304 further includes mode control valves 322, heat exchanger flow control valves 324, air-to-fluid heat exchangers 326, supply line bypass valve 328, and return line bypass valve 330. Hydronic system 304 can further include temperature sensors 332 and controller 334. Thermal system and hydronic system 300 can also include fans 336. Pump 338 can be included in the hydronic system 304.

Thermal system and hydronic system 300 is configured such that thermal system 302 is operated to add or remove heat from a process fluid circulated within hydronic system 304. The process fluid can exchange heat with load 318 so as to service heating and/or cooling needs at the load 318.

Thermal system 302 is a reversible thermal system configured to circulate a working fluid so as to add or remove heat from the process fluid. Thermal system 302 includes a compressor 306. Compressor 306 can be any suitable compressor for compressing the working fluid. In an embodiment, multiple compressors 306 can be provided as the compressor 306 as shown in FIG. 3. Compressed working fluid discharged from the compressor 306 is then directed to flow reverser 308. Flow reverser 308 is a flow control configured to control a direction of flow through the thermal system 302 by directing the discharge from the compressor 306 to either first heat exchanger 310 or the one or more second heat exchangers 314. In the heating mode, the flow reverser 308 directs the discharge of the compressor 306 to first heat exchanger 310, and directs working fluid received from the one or more second heat exchangers 314 to the compressor 306. In the cooling mode, the flow reverser 308 directs the discharge of the compressor 306 to the one or more second heat exchangers 314, and directs working fluid received from the first heat exchanger 310 to the compressor 306.

The first heat exchanger 310 is a heat exchanger configured to exchange heat between the working fluid and process fluid being circulated through the hydronic system 304. In the heating mode, the first heat exchanger 310 operates as a condenser for the working fluid, where the working fluid rejects heat, thus heating the process fluid in the hydronic system 304. In the cooling mode, the first heat exchanger 310 operates as an evaporator, with the working fluid absorbing heat, thereby cooling the process fluid.

An expander 312 is provided between the first heat exchanger 330 and the one or more second heat exchangers 314. The expander 312 can be any suitable expander capable of expanding received working fluid, such as, for example, an expansion valve, an expansion plate, an expansion vessel, one or more expansion orifices, or any other known suitable structure for expanding the working fluid. In an embodiment, the expander 312 is an electronic expansion valve.

Thermal system 302 further includes one or more second heat exchangers 314. The second heat exchanger(s) 330 are heat exchangers configured to exchange heat with an ambient environment or other suitable source/sink for heat. In an embodiment, the one or more second heat exchangers 314 are outdoor heat exchangers configured to exchange heat with air in the ambient environment of thermal system 302. In an embodiment, frost can build up on at least one of the one or more second heat exchangers 314 based on the ambient temperature and operations of the thermal system 302, for example when the thermal system is being operated to provide heating at ambient temperatures below freezing. In the heating mode, the one or more second heat exchangers 314 operate as an evaporator, with the working fluid absorbing heat from the ambient environment. In the cooling mode, the one or more second heat exchangers 314 operate as a condenser for the working fluid, where the working fluid rejects heat to the ambient environment.

Hydronic system 304 is configured to circulate the process fluid from the first heat exchanger 310, where the process fluid absorbs or rejects heat according to the operating mode of thermal system 302, and load 318, where the process fluid exchanges heat to provide heating or cooling to service the load 318. In hydronic system 304, the process fluid can be driven to circulate by operation of a pump 338. In an embodiment, the pump 338 can be provided at a different position in the hydronic system 304. In an embodiment, multiple pumps 338 can be provided to circulate the process fluid in hydronic system 304. Hydronic system 304 includes the process fluid side of first heat exchanger 310, at which the process fluid absorbs heat from or rejects heat to the working fluid of thermal system 302. Hydronic system 304 includes a supply line 316 from the first heat exchanger 310 to the load 318, which conveys the process fluid to the load 318. In an embodiment, the pump 338 is disposed along the supply line 316. The load 318 can be any suitable heating and/or cooling load to be serviced by operation of thermal system and hydronic system 300. The load 318 can be, as non-limiting examples, a heating and/or cooling load of a conditioned space, a heat exchanger of another thermal system in a cascade arrangement with the thermal system and hydronic system 300, or the like. Process fluid is returned from the load 318 by way of return line 320.

The hydronic system 304 further includes mode control valves 322. Mode control valves 322 are three-way valves or assemblies including a plurality of valves. The mode control valves 322 are configured to control the supply of process fluid to the air-to-fluid heat exchangers 326 and the return of the process fluid from the air-to-fluid heat exchangers 326 such that either supply line 316 or return line 320 is the line of hydronic system 304 that provides process fluid to and receives the process fluid back from the air-to-fluid heat exchangers 326.

Heat exchanger flow control valves 324 are controllable valves provided for each of air-to-fluid heat exchangers 326. The heat exchanger flow control valves 324 can be provided between one of the mode control valves 322 and the respective air-to-fluid heat exchanger 326 that the heat exchanger flow control valve 324 is associated with. Heat exchanger flow control valves 324 can be any suitable valves capable of providing a variable flow or preventing flow into the corresponding air-to-fluid heat exchanger 224.

The air-to-fluid heat exchangers 326 are one or more heat exchangers provided in proximity to the one or more second heat exchangers 314. In an embodiment, the air-to-fluid heat exchanger 326 and the corresponding second heat exchanger 314 can be provided in a single multi-function heat exchange structure. In an embodiment, one air-to-fluid heat exchanger 326 is provided for each of the one or more second heat exchangers 314. The air-to-fluid heat exchangers 326 can be in heat exchange relationships with the one or more second heat exchangers 314, either directly by having a portion in contact with the corresponding one or more second heat exchangers 314, or indirectly by way of the air at the air-to-fluid heat exchanger 326 and corresponding second heat exchanger 314, such as an airflow being driven by a corresponding fan 336. The process fluid can absorb or reject heat at the air-to-fluid heat exchangers 326, based on the ambient conditions and/or the temperature at the second heat exchanger 314. In an embodiment, the process fluid can reject heat at the air-to-fluid heat exchanger 326 such that the heat is at least partially absorbed by frost buildup on the corresponding second heat exchanger 314, thereby melting the frost buildup and defrosting the second heat exchanger 314.

Supply line 316 includes supply line bypass valve 328. Supply line bypass valve 328 is a controllable valve configured to regulate flow through the supply line 316. The supply line bypass valve 328 can be positioned between the pipes connected to the respective mode control valves 322. Flow through supply line bypass valve 328 does not pass to the mode control valves 322 and thus passes from first heat exchanger 310 to load 318 without passing through any of the air-to-fluid heat exchangers 326.

Return line 320 includes return line bypass valve 330. Return line bypass valve 330 is a controllable valve configured to regulate flow through the return line 320. The return line bypass valve 330 can be positioned between the pipes connected to the respective mode control valves 322. Flow through return line bypass valve 330 does not pass to the mode control valves 322 and thus passes from load 318 to first heat exchanger 310 without passing through any of the air-to-fluid heat exchangers 326.

Temperature sensors 332 can be provided in hydronic system 304. The temperature sensors 332 can be positioned to measure suitable temperatures for control of the hydronic system 304, for example a supply temperature in supply line 316, a return temperature in return line 320, a thermal system entering temperature at an inlet of the process fluid side of first heat exchanger 310, and/or a thermal system leaving temperature at an outlet of the process fluid side of the first heat exchanger 310. The thermal system and hydronic system 300 can include a controller 334. In an embodiment, the controller 334 is configured to control the mode control valves 322, heat exchanger flow control valves 324, supply line bypass valve 328, and/or return line bypass valve 330. The controller 334 can be configured to control the mode control valves 322, heat exchanger flow control valves 324, supply line bypass valve 328, and/or return line bypass valve 330 based on, for example, a call to perform a defrosting operation, to achieve particular target values for a least one of the temperatures measured by the temperature sensors 332, or any other suitable basis for controlling the mode control valves 322, heat exchanger flow control valves 324, supply line bypass valve 328, and/or return line bypass valve 330.

Fans 336 can be provided at the one or more second heat exchangers 314 and the corresponding air-to-fluid heat exchangers 326. In an embodiment, the fans 336 can be controllable fans having variable speed. In an embodiment, the fans 336 can be reversible such that air can be pulled through or pushed into the second heat exchanger 314 and air-to-fluid heat exchanger 326. In an embodiment, the reversibility of the fan 336 can allow either of second heat exchanger 314 or air-to-fluid heat exchanger 326 to be the first of the respective heat exchangers 314, 326, that first receives the ambient air being driven or drawn by the fan 336.

Figure 4:
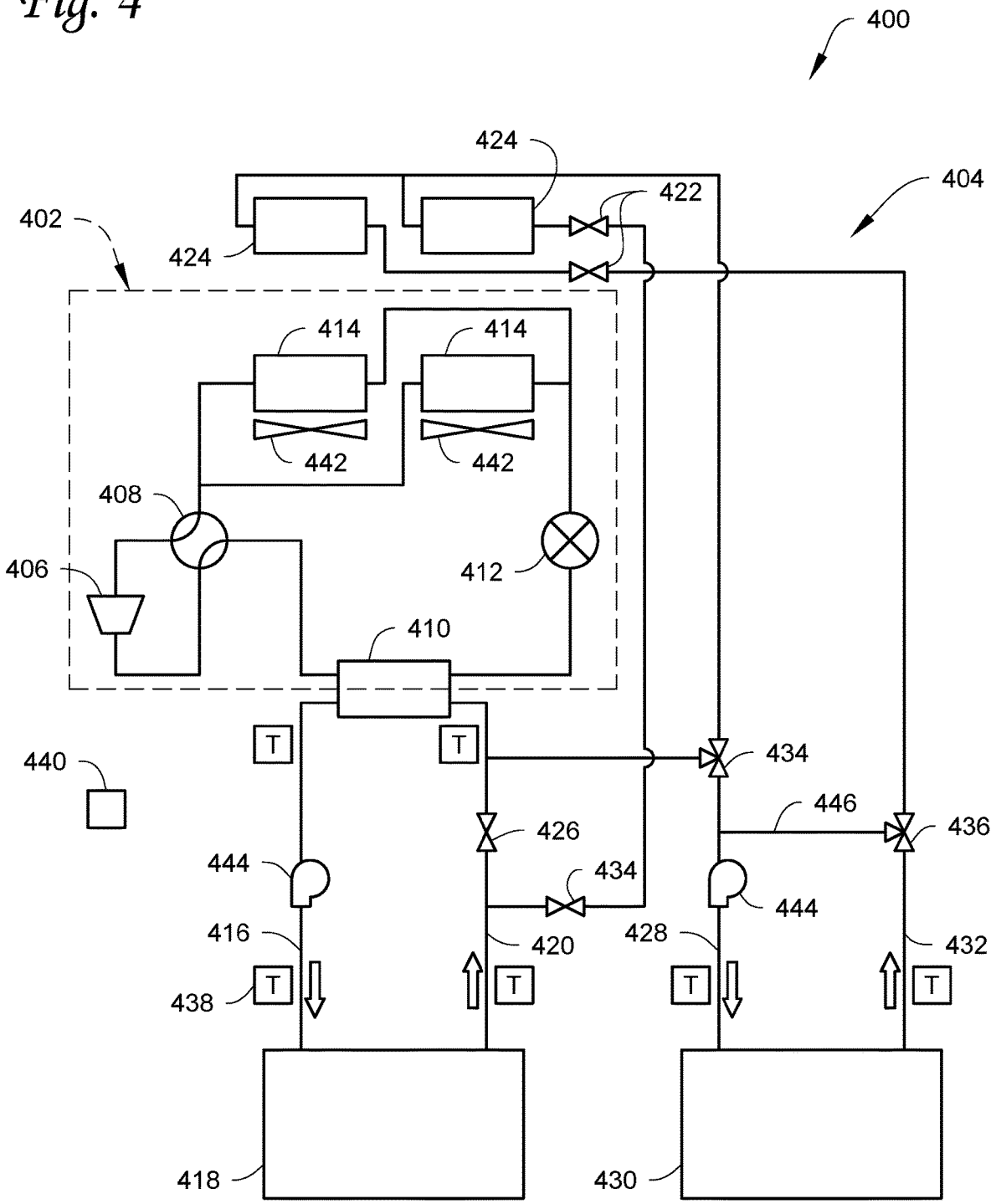
FIG. 4 shows a schematic of a thermal system and a hydronic system according to an embodiment.

FIG. 4 shows a schematic of a thermal system and a hydronic system according to an embodiment. Thermal system and hydronic system 400 includes thermal system 402 and hydronic system 404. Thermal system 402 includes a compressor 406, a flow reverser 408, a first heat exchanger 410, an expander 412, and one or more second heat exchanger(s) 414. The hydronic system 404 includes the first heat exchanger 410, a supply line 416 from the first heat exchanger 410 to a load 418, a return line 420 from the primary load 418 to the first heat exchanger 410. The hydronic system 404 further includes controllable valves 422, air-to-fluid heat exchangers 424, and bypass valve 426. Hydronic system 404 additionally includes secondary load supply line 428, secondary load 430, secondary load return line 432, cooling/defrost control valves 434 and heating control valve 436. Hydronic system 404 can further include temperature sensors 438 and controller 440. Thermal system and hydronic system 400 can also include fans 442. Pumps 444 can be included in the hydronic system 404.

Thermal system and hydronic system 400 is configured such that thermal system 402 is operated to add or remove heat from a process fluid circulated within hydronic system 404. The process fluid can exchange heat with primary load 418 so as to service heating and/or cooling needs at the primary load 418.

Thermal system 402 is a reversible thermal system configured to circulate a working fluid so as to add or remove heat from the process fluid. Thermal system 402 includes a compressor 406. Compressor 406 can be any suitable compressor for compressing the working fluid. In an embodiment, multiple compressors 406 can be provided as the compressor 406 as shown in FIG. 4. Compressed working fluid discharged from the compressor 406 is then directed to flow reverser 408. Flow reverser 408 is a flow control configured to control a direction of flow through the thermal system 402 by directing the discharge from the compressor 406 to either first heat exchanger 410 or the one or more second heat exchangers 414. In the heating mode, the flow reverser 408 directs the discharge of the compressor 406 to first heat exchanger 410, and directs working fluid received from the one or more second heat exchangers 414 to the compressor 406. In the cooling mode, the flow reverser 408 directs the discharge of the compressor 406 to the one or more second heat exchangers 414, and directs working fluid received from the first heat exchanger 410 to the compressor 406.

The first heat exchanger 410 is a heat exchanger configured to exchange heat between the working fluid and process fluid being circulated through the hydronic system 404. In the heating mode, the first heat exchanger 410 operates as a condenser for the working fluid, where the working fluid rejects heat, thus heating the process fluid in the hydronic system 404. In the cooling mode, the first heat exchanger 410 operates as an evaporator, with the working fluid absorbing heat, thereby cooling the process fluid.

An expander 412 is provided between the first heat exchanger 410 and the one or more second heat exchangers 414. The expander 412 can be any suitable expander capable of expanding received working fluid, such as, for example, an expansion valve, an expansion plate, an expansion vessel, one or more expansion orifices, or any other known suitable structure for expanding the working fluid. In an embodiment, the expander 412 is an electronic expansion valve.

Thermal system 402 further includes one or more second heat exchangers 414. The second heat exchanger(s) 414 are heat exchangers configured to exchange heat with an ambient environment or other suitable source/sink for heat. In an embodiment, the one or more second heat exchangers 414 are outdoor heat exchangers configured to exchange heat with air in the ambient environment of thermal system 402. In an embodiment, frost can build up on at least one of the one or more second heat exchangers 414 based on the ambient temperature and operations of the thermal system 402, for example when the thermal system is being operated to provide heating at ambient temperatures below freezing. In the heating mode, the one or more second heat exchangers 414 operate as an evaporator, with the working fluid absorbing heat from the ambient environment. In the cooling mode, the one or more second heat exchangers 414 operate as a condenser for the working fluid, where the working fluid rejects heat to the ambient environment.

Hydronic system 404 is configured to circulate the process fluid from the first heat exchanger 410, where the process fluid absorbs or rejects heat according to the operating mode of thermal system 402, and primary load 418, where the process fluid exchanges heat to provide heating or cooling to service the primary load 418. Hydronic system 404 is further configured to selectively circulate process fluid to a secondary load 430. The process fluid can be circulated between secondary load 430 and the air-to-fluid heat exchangers 424, such that the air-to-fluid heat exchangers are the heat source or heat sink supporting heating or cooling, respectively, of the secondary load 430. In hydronic system 404, the process fluid can be driven to circulate by operation of a pumps 444. Pumps 444 can be included in the supply or return associated with the primary load 418, and also in the supply or return associated with the secondary load 430. In an embodiment, the pump 444 can be provided at a different position in the hydronic system 404. In an embodiment, multiple pumps 444 can be provided to circulate the process fluid in hydronic system 404. Hydronic system 404 includes the process fluid side of first heat exchanger 410, at which the process fluid absorbs heat from or rejects heat to the working fluid of thermal system 402. Hydronic system 416 includes a supply line 416 from the first heat exchanger 410 to the primary load 418, which conveys the process fluid to the primary load 418. In an embodiment, the pump 444 is disposed along the supply line 416. The primary load 418 can be any suitable heating and/or cooling load to be serviced by operation of thermal system and hydronic system 400. The load can be, as non-limiting examples, a heating and/or cooling load of a conditioned space, a heat exchanger of another thermal system in a cascade arrangement with the thermal system and hydronic system 400, or the like. Process fluid is returned from the primary load 418 by way of return line 420.

Controllable valves 422 are provided to regulate flow of process fluid from the return line 420 to each of the air-to-fluid heat exchangers 424. Controllable valves 422 can be any suitable valves capable of providing a variable flow or preventing flow into the corresponding air-to-fluid heat exchanger 424. One controllable valve 422 can be provided for each of the air-to-fluid heat exchangers 424.

The air-to-fluid heat exchangers 424 are one or more heat exchangers provided in proximity to the one or more second heat exchangers 414. In an embodiment, the air-to-fluid heat exchanger 424 and the corresponding second heat exchanger 414 can be provided in a single multi-function heat exchange structure. In an embodiment, one air-to-fluid heat exchanger 424 is provided for each of the one or more second heat exchangers 414. The air-to-fluid heat exchangers 424 can be in heat exchange relationships with the one or more second heat exchangers 414, either directly by having a portion in contact with the corresponding one or more second heat exchangers 414, or indirectly by way of the air at the air-to-fluid heat exchanger 424 and corresponding second heat exchanger 414, such as an airflow being driven by a corresponding fan 442. The process fluid can absorb or reject heat at the air-to-fluid heat exchangers 424, based on the ambient conditions and/or the temperature at the second heat exchanger 414. The process fluid that is heated or cooled by the absorption or rejection of heat, respectively, can be circulated to secondary load 430 to provide heating or cooling so as to service said secondary load 430.

A bypass valve 426 is provided along the return line 420. The bypass valve 426 can regulate flow that passes through return line 420 without passing to the controllable valves 422 and thus bypasses the air-to-fluid heat exchangers 424.

Secondary load supply line 428 is a fluid line configured to convey process fluid from the air-to-fluid heat exchangers 424 to the secondary load 430. Secondary load supply line 428 can extend from one of the load/defrost control valves 434 to the secondary load 430.

Secondary load 430 can be a heating or cooling load capable of being serviced by the process fluid based on the range of temperatures that can be provided by exchange of heat at the air-to-fluid heat exchanger. As non-limiting examples, the secondary load 430 can be a reheating load, a dehumidification load, a sensible heating load, a sensible cooling load, heating or cooling loads for specific portions of a conditioned space, pre-heating or pre-cooling loads, or the like. In an embodiment, the secondary load 430 is an opposite type of load from the primary load 418. For example, where the primary load 418 is a heating load, the secondary load 430 can be a cooling load, and vice versa. In an embodiment, the secondary load 430 can be of the same heating or cooling type, but having different temperature requirements from the primary load 418.

Secondary load return line 432 is a fluid line configured to convey process fluid from the secondary load 430 back to the air-to-fluid heat exchangers 424. Secondary load return line 432 can extend from the secondary load 430 to another of the load/defrost control valves 434.

Load/defrost control valves 434 are a set of valves that can include two-way valves, three-way valves, and/or or assemblies of multiple valves, and that are configured to control the fluid connections of hydronic system 404 to control whether the air-to-fluid heat exchangers 424 are in communication with primary load 418 and first heat exchanger 410, or secondary load 430. In a load servicing mode, load/defrost control valves 434 can be configured to block flow from the return line 420 from primary load 418 to the air-to-fluid heat exchangers 424 and vice versa, and to permit circulation of the process fluid between the air-to-fluid heat exchanger 424 and the secondary load 430 by way of the secondary load supply line 428 and secondary load return load 432. In a defrost mode, or any other suitable operating mode where the secondary load 430 is not being serviced, the load/defrost control valves can be configured to block flow of the process fluid into the secondary load supply line 428 and from secondary load return line 432, and to permit flow from the return line 420 from primary load 418 to the air-to-fluid heat exchangers 424 and back to return line 420.

Heating control valve 436 can be provided to allow at least some of the process fluid being circulated to and from secondary load 430 to bypass the air-to-fluid heat exchangers 424. Heating control valve 436 can be a controllable three-way valve or an assembly including multiple valves that is configured to modulate a flow through one of secondary load return line 432 and allow the diversion of at least some of the flow through the secondary load return line 432 to the secondary load supply line 428, for example by way of a bypass line 446 or any other suitable fluid connection.

Temperature sensors 438 can be provided in hydronic system 404. The temperature sensors 438 can be positioned to measure suitable temperatures for control of the hydronic system 404, for example a primary supply temperature in supply line 416, a primary return temperature in return line 420, a thermal system entering temperature at an inlet of the process fluid side of first heat exchanger 410, a thermal system leaving temperature at an outlet of the process fluid side of the first heat exchanger 410, a secondary load supply temperature in secondary load supply line 428, a secondary load return temperature in secondary load return line 432, and/or temperatures at air-to-fluid heat exchangers 424. The thermal system and hydronic system 400 can include a controller 440. In an embodiment, the controller 440 is configured to control the controllable valves 422, bypass valve 426, load/defrost control valves 434, and/or heating control valve 436. The controller 440 can be configured to control the controllable valves 422, bypass valve 426, load/defrost control valves 434, and/or heating control valve 436, for example, through calls for heating or cooling at the secondary load, a call to perform a defrosting operation, to achieve particular target values for a least one of the temperatures measured by the temperature sensors 438, or any other suitable basis for controlling the controllable valves 422, bypass valve 426, load/defrost control valves 434, and/or heating control valve 436.

Fans 442 can be provided at the one or more second heat exchangers 414 and the corresponding air-to-fluid heat exchangers 424. In an embodiment, the fans 442 can be controllable fans having variable speed. In an embodiment, the fans 442 can be reversible such that air can be pulled through or pushed into the second heat exchanger 414 and air-to-fluid heat exchanger 424. In an embodiment, the reversibility of the fan 442 can allow either of second heat exchanger 414 or air-to-fluid heat exchanger 424 to be the first of the respective heat exchangers 414, 424, that first receives the ambient air being driven or drawn by the fan 442.

Figure 5:
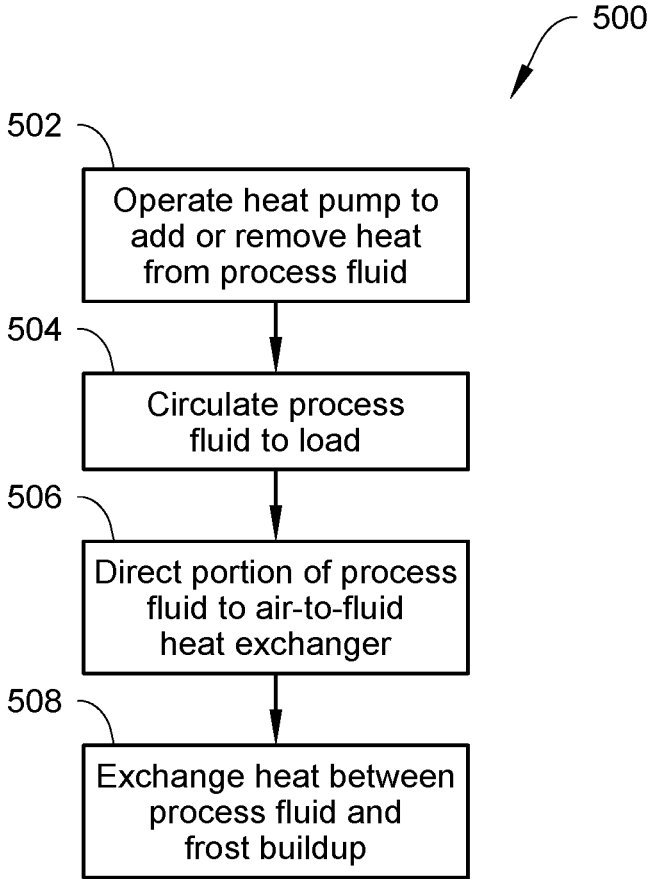
FIG. 5 shows a method of operating a thermal system and a hydronic system to defrost the thermal system.

FIG. 5 shows a method of operating a thermal system and a hydronic system to defrost the thermal system. Method 500 includes operating a thermal system to add or remove heat from the process fluid 502, circulating the process fluid to a load 504, directing at least a portion of the process fluid to an air-to-fluid heat exchanger 506, and exchanging heat between process fluid at the air-to-fluid heat exchanger and frost buildup at an outdoor heat exchanger of the thermal system 508.

The thermal system is operated to add or remove heat from the process fluid at 502. Operation to add or remove heat at 502 can include compressing a working fluid, condensing the working fluid at one heat exchanger, expanding the working fluid, and evaporating the working fluid at another heat exchanger. The process fluid can be heated at a heat exchanger when the working fluid is being condensed, or cooled when the working fluid is being evaporated at the heat exchanger. During such operations, frost can form on a heat exchanger where the working fluid exchanges heat with an ambient environment, such as the one or more second heat exchangers 114 of thermal system 102, particularly when the thermal system is operated to add heat to the process fluid during a heating operation at cold ambient conditions.

After the process fluid has been heated or cooled at 502, it is circulated to a load at 504 to provide heating or cooling to said load. The load can be, for example, a heating load or a cooling load of a conditioned space, a cascade heat exchanger of another thermal system circuit, or the like. The process fluid can then pass back from the load to the thermal system to again be heated or cooled at 502.

During a defrost operation according to method 500, at least a portion of the process fluid is directed to an air-to-fluid heat exchanger at 506. The defrost operation at 506 can be performed based on a command from a controller. The portion of the process fluid can be sourced from a supply line from the thermal system to the load, or a return line from the load to the thermal system. The direction of the process fluid to the air-to-fluid heat exchanger at 506 can be performed using valves controlled by the controller. The portion of the process fluid can be directed by suitable valves and piping to pass to an air-to-fluid heat exchanger.

At the air-to-fluid heat exchanger, the diverted working fluid exchanges heat with frost buildup at an outdoor heat exchanger of the thermal system 508, such as any of second heat exchangers 114, 214, 314, or 414 as described above and shown in FIGS. 1-4. The air-to-fluid heat exchanger is positioned such that it can exchange heat with the outdoor heat exchanger of the thermal system, either directly or by way of air between the air-to-fluid heat exchanger and the outdoor heat exchanger. The air can, for example, be drawn or driven over both the air-to-fluid heat exchanger and the outdoor heat exchanger by one or more fans. The diverted working fluid is at a relatively higher temperature than the freezing point of water, and thus rejects heat to the frost buildup, thus melting the frost buildup off of the outdoor heat exchanger. Process fluid leaving the air-to-fluid heat exchanger can rejoin the process fluid being circulated between the thermal system and the load, for example being returned to the side from which the process fluid was obtained at 506.

Figure 6:
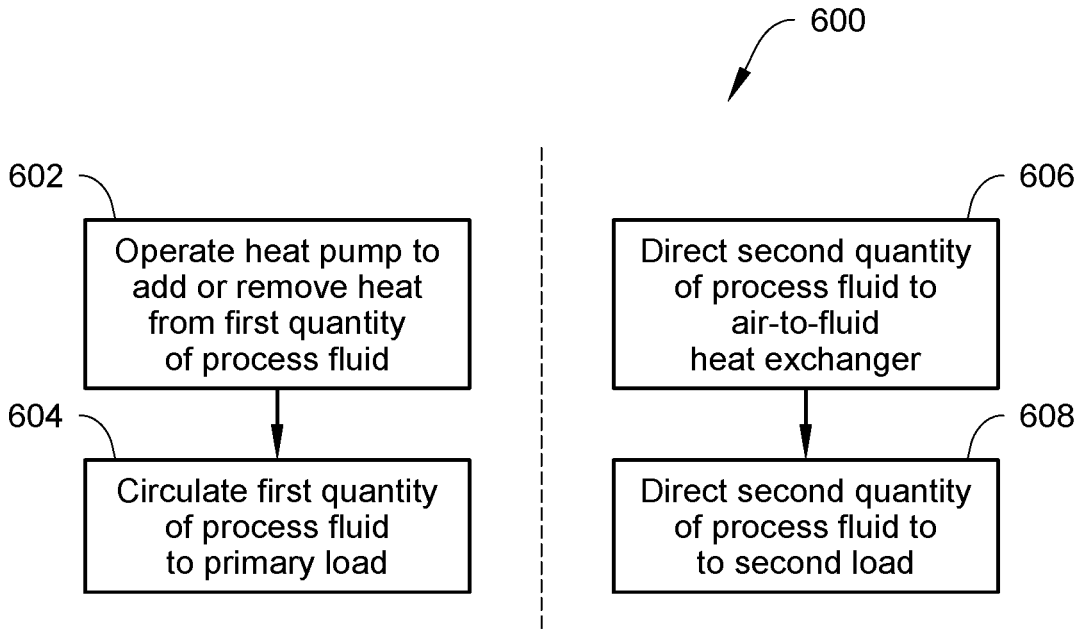
FIG. 6 shows a method of operating a thermal system and a hydronic system to support simultaneous heating and cooling operations.

FIG. 6 shows a method of operating a thermal system and a hydronic system to support simultaneous heating and cooling operations. Method 600 includes operating a first thermal system to add or remove heat from a first quantity of process fluid 602, circulating the first quantity of process fluid to a primary load 604, directing a second quantity of the process fluid to an air-to-fluid heat exchanger 606, and directing the second quantity of the process fluid from the air-to-fluid heat exchanger to a secondary load 608. Method 600 can be performed using, for example, thermal system and hydronic system 400 as described above and shown in FIG. 4.

The thermal system is operated to add or remove heat from a first portion of the process fluid at 602. The first portion of the process fluid is the portion circulating between the thermal system and the primary load. The first portion of the process fluid can be kept separate from a second portion of the process fluid that is circulated between the air-to-fluid heat exchanger and a secondary load. For example, valves in the hydronic system can be closed to prevent flow between the part of the hydronic system circulating process fluid from the thermal system to the primary load and the part of the hydronic system circulating process fluid from the air-to-fluid heat exchanger to the secondary load. The operation to add or remove heat at 602 can include compressing a working fluid, condensing the working fluid at one heat exchanger, expanding the working fluid, and evaporating the working fluid at another heat exchanger. The first portion of the process fluid can be heated at a heat exchanger when the working fluid is being condensed, or cooled when the working fluid is being evaporated at the heat exchanger.

After the first quantity of process fluid has been heated or cooled at 602, it is circulated to a primary load at 604 to provide heating or cooling to said load. The load can be, for example, a heating load or a cooling load of a conditioned space, or the like. The first portion of the process fluid can then pass back from the load to the thermal system to again be heated or cooled at 602.

A second quantity of the process fluid is directed to an air-to-fluid heat exchanger 606. The second quantity of the process fluid is a portion of the process fluid in the hydronic system that is circulated between the air-to-fluid heat exchanger and the secondary load. The second quantity of the process fluid can be kept separate from the first quantity of the process fluid, for example due to closure of valves included in the hydronic system. At the air-to-fluid heat exchanger 606, the second quantity of process fluid can absorb or reject heat, depending on the temperature of the second quantity of the process fluid and ambient conditions, heat being absorbed or rejected by the outdoor heat exchanger of the thermal system circuit, operation of one or more fans directing airflow over the outdoor heat exchanger and/or the air-to-fluid heat exchanger, or the like. In an embodiment, fans can be controlled to achieve a certain temperature for the second quantity of the process fluid as it leaves the air-to-fluid heat exchanger.

The second quantity of the process fluid is directed from the air-to-fluid heat exchanger to a secondary load at 608. The secondary load can be a heating or cooling load capable of being serviced by the process fluid based on the range of temperatures that can be provided by exchange of heat at the air-to-fluid heat exchanger. As non-limiting examples, the secondary load can be a reheating load, a dehumidification load, a sensible heating load, a sensible cooling load, heating or cooling loads for specific portions of a conditioned space, or the like. In an embodiment, the secondary load is an opposite type of load from the primary load. For example, where the primary load is a heating load, the secondary load can be a cooling load, and vice versa. In an embodiment, the secondary load can be of the same heating or cooling type, but having different temperature requirements from the primary load. At the secondary load, the second quantity of the process fluid can absorb or reject heat based on the relative temperature difference between the second quantity of process fluid and the secondary load. The second quantity of process fluid can circulate back to the air-to-fluid heat exchanger to absorb or reject heat at 606 to continue servicing the secondary load at 608.

Figure 7:
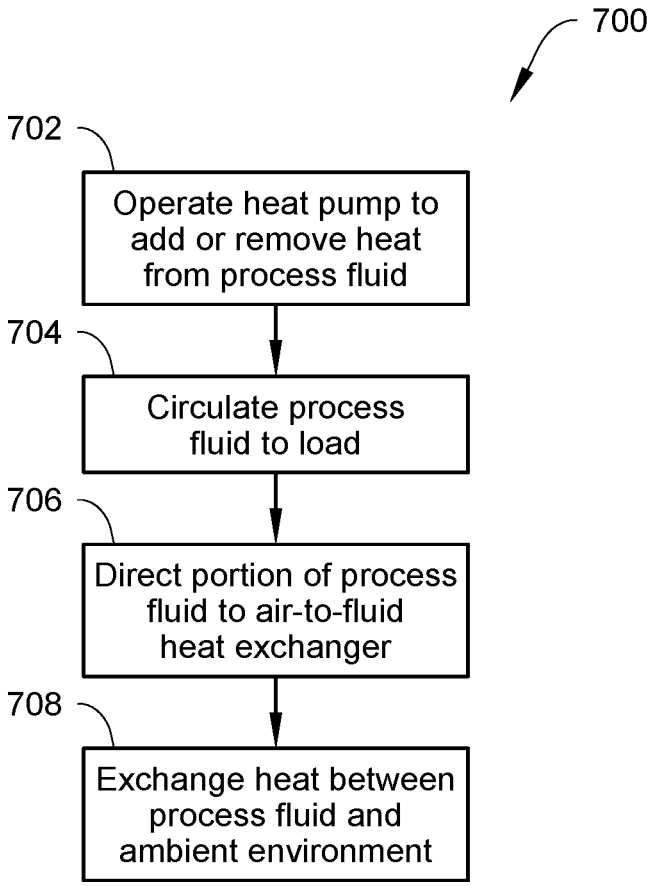
FIG. 7 shows a method of operating a thermal system and a hydronic system to support pre-heating or pre-cooling.

FIG. 7 shows a method of operating a thermal system and a hydronic system to support pre-heating or pre-cooling. Method 700 includes operating a first thermal system to add or remove heat from the process fluid 702, circulating the process fluid to a load 704, directing at least a portion of the process fluid to an air-to-fluid heat exchanger 706, and exchanging heat between process fluid at the air-to-fluid heat exchanger and the ambient environment at an outdoor heat exchanger of the first thermal system 708 to pre-heat or pre-cool the process fluid.

Method 700 can be performed under certain conditions, when heating or cooling of process fluid at the air-to-fluid heat exchanger is capable of supporting the heating or cooling operation of the thermal system. This determination can be based on one or more of the ambient temperature, the supply temperature of the process fluid, the return temperature of the process fluid, predicted heating or cooling at the air-to-fluid heat exchanger, temperature at the outdoor heat exchanger of the thermal system, temperature targets for the supply, efficiency data for the thermal system circuit, and the like.

A thermal system is operated to add or remove heat from the process fluid at 702. Operation to add or remove heat at 702 can include compressing a working fluid, condensing the working fluid at one heat exchanger, expanding the working fluid, and evaporating the working fluid at another heat exchanger. The process fluid can be heated at a heat exchanger when the working fluid is being condensed, or cooled when the working fluid is being evaporated at the heat exchanger.

After the process fluid has been heated or cooled at 702, it is circulated to a load at 704 to provide heating or cooling to said load. The load can be, for example, a heating load or a cooling load of a conditioned space, or the like. The first portion of the process fluid can then pass back from the load to the thermal system to again be heated or cooled at 702.

When pre-heating or pre-cooling according to method 700, at least a portion of the process fluid is directed to an air-to-fluid heat exchanger at 706. The process fluid can be sourced from a supply line or a return line, depending on the piping arrangement and/or whether the process fluid is to be pre-heated or pre-cooled. The direction of the portion of process fluid to the air-to-fluid heat exchanger at 706 can be performed by operation of one or more valves by a controller. In an embodiment, the process fluid is sourced from the return line. In an embodiment, the amount of process fluid directed to the air-to-fluid heat exchanger at 706 is controlled based on the ability to achieve a temperature that supports the heating or cooling operation being performed by the thermal system adding or removing heat from the process fluid at 702.

Heat is exchanged between the process fluid at the air-to-fluid heat exchanger and the ambient environment at an outdoor heat exchanger of the first thermal system at 708 to pre-heat or pre-cool the process fluid. In an embodiment, the process fluid at the air-to-fluid heat exchanger can reject heat at the air-to-fluid heat exchanger at 708 based on the ambient conditions, operation of a fan, temperatures at the outdoor heat exchanger of the first thermal system, and the like, thereby cooling the process fluid to support operation of the thermal system to cool the load. In an embodiment, the process fluid at the air-to-fluid heat exchanger can absorb heat at the air-to-fluid heat exchanger at 708 based on the ambient conditions, operation of a fan, temperatures at the outdoor heat exchanger of the first thermal system, and the like, thereby heating the process fluid to support operation of the thermal system to heat the load. In an embodiment, the process fluid a. The pre-heated or pre-cooled process fluid can join the remainder of the process fluid circulated between the thermal system and the load so as to be heated or cooled by the thermal system at 702 and service the heating or cooling load at 704.

Figure 8:
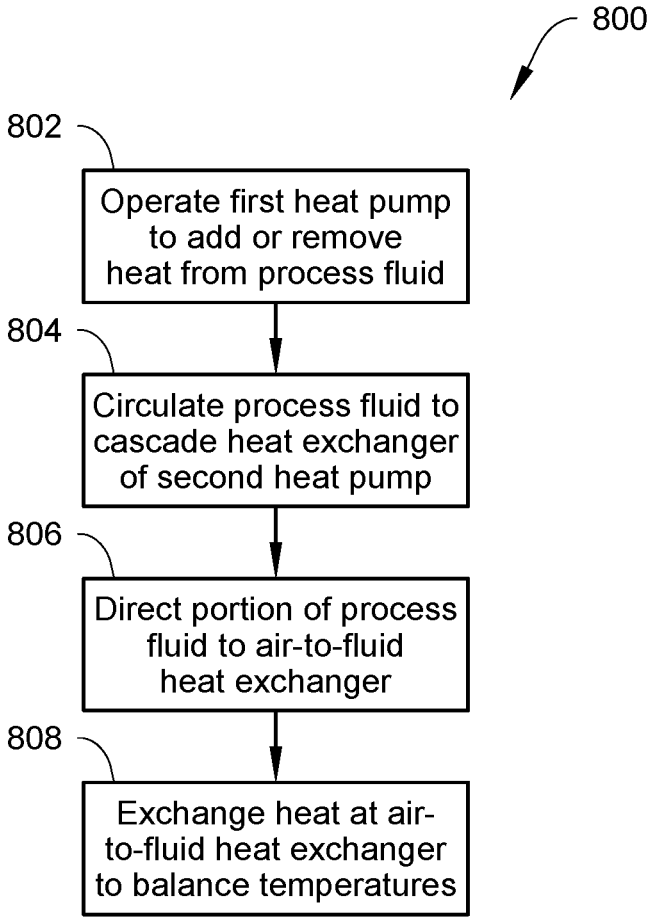
FIG. 8 shows a method of operating a thermal system and a hydronic system to support cascade operation.

FIG. 8 shows a method of operating a thermal system and a hydronic system to support cascade operation. Method 800 includes operating a first thermal system to add or remove heat from the process fluid 802, circulating the process fluid to a cascade heat exchanger of a second thermal system 804, directing the at least a portion of the process fluid to an air-to-fluid heat exchanger 806, and exchanging heat between process fluid and an environment at the air-to-fluid heat exchanger 808.

A first thermal system is operated to add or remove heat from the process fluid 802, The first thermal system can be a thermal system that is in a cascade arrangement with a second thermal system, configured to supply heating or cooling to support operation of the second thermal system. Operation to add or remove heat at 802 can include compressing a working fluid, condensing the working fluid at one heat exchanger, expanding the working fluid, and evaporating the working fluid at another heat exchanger. The process fluid can be heated at a heat exchanger when the working fluid is being condensed, or cooled when the working fluid is being evaporated at the heat exchanger.

The process fluid is circulated from the first thermal system to a cascade heat exchanger of a second thermal system 804. At the cascade heat exchanger, the process fluid exchanges heat with a working fluid of the second thermal system. In an embodiment, the first thermal system heats the process fluid at 802, with the process fluid used as a heat source to support heating operations of the second thermal system. In an embodiment, the first thermal system cools the process fluid at 802, with the process fluid used as a heat sink to support cooling operations of the second thermal system.

A portion of the process fluid is directed to an air-to-fluid heat exchanger 806. The portion of the process fluid directed to the air-to-fluid heat exchanger can be an amount selected to balance the operations of the first and second thermal systems, for example to achieve a target supply temperature to the second thermal system and/or a target return temperature to the first thermal system. The amount of process fluid that is directed to the air-to-fluid heat exchanger can be based on one or more of the ambient temperature, the supply temperature of the process fluid, the return temperature of the process fluid, predicted heating or cooling at the air-to-fluid heat exchanger, temperature at the outdoor heat exchanger of the first thermal system, supply and/or return temperature targets, efficiency data for the first and/or second thermal system, and the like. The amount can be determined by a controller. A controller can control valves of the hydronic system to direct the amount of the process fluid to the air-to-fluid heat exchanger at 806. In an embodiment, the controller can control valves of the hydronic system so as to achieve a target fluid inlet temp from the first thermal system to the cascade heat exchanger.

Heat is exchanged between the process fluid and the environment at the air-to-fluid heat exchanger at 808. Based on the temperature of the process fluid and the ambient temperature, temperature at the outdoor heat exchanger of the first thermal system, and/or operation of fans, the process fluid absorbs or rejects heat. The process fluid then joins the process fluid being circulated between the first thermal system and the second thermal system, thereby affecting the supply and/or return temperatures at the respective thermal systems. The effects on the supply and/or return temperatures can be controlled, for example by controlling the portion of the process fluid that is directed to the air-to-fluid heat exchanger at 806, to allow one or both of the first and second thermal systems to be operated at more efficient operational settings without creating imbalances in the heating or cooling of the process fluid between the first and second thermal systems.

Figure 9:
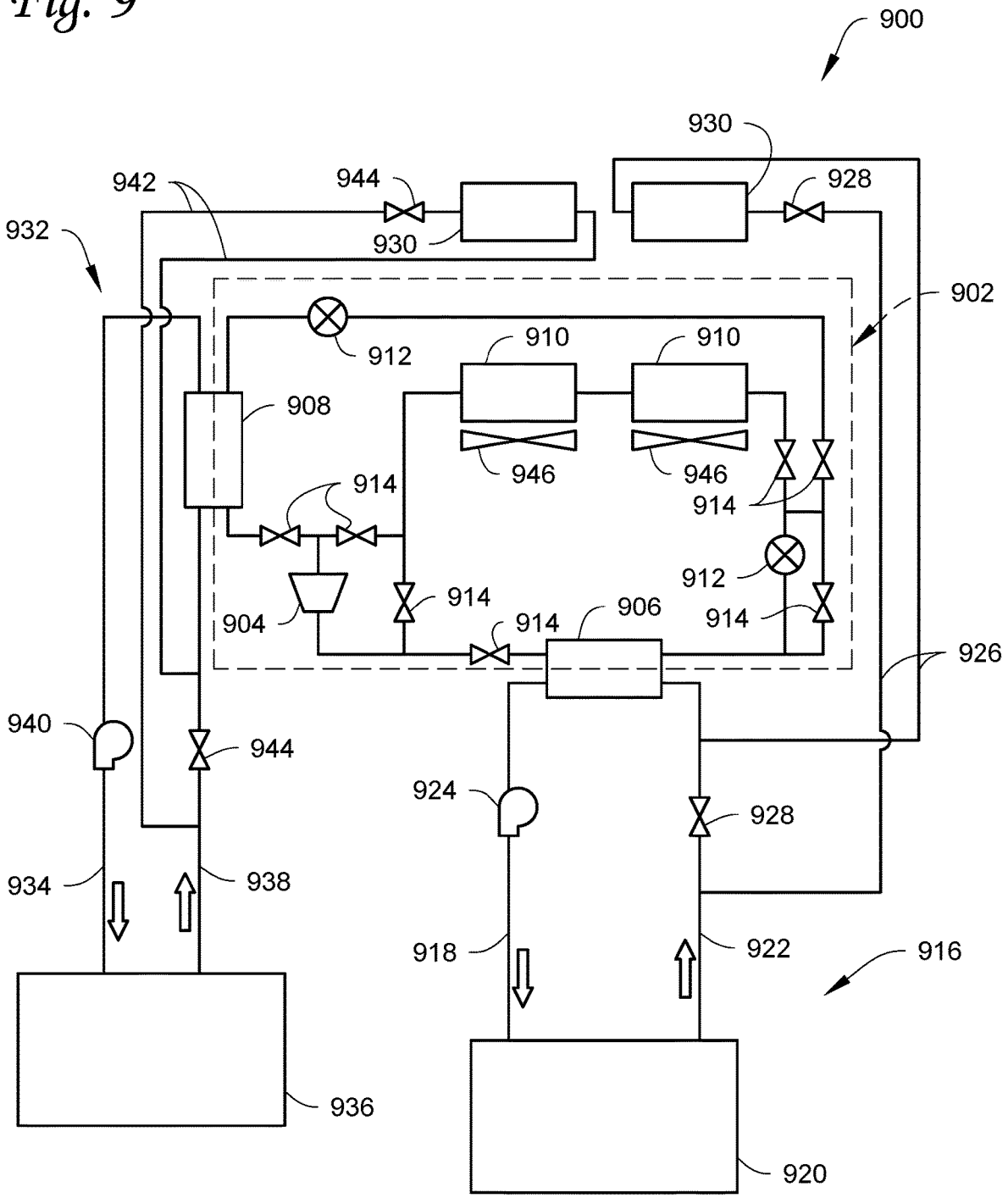
FIG. 9 shows a schematic of a heating and cooling system according to an embodiment.

FIG. 9 shows a schematic of a heating and cooling system according to an embodiment. Heating and cooling system 900 includes thermal system 902. The thermal system 902 includes one or more compressors 904, at least one first heat exchanger 906, at least one second heat exchanger 908, and at least one third heat exchanger 910. Thermal system 902 includes one or more expanders 912 and valves 914.

Heating and cooling system 900 further includes first process fluid circuit 916. First process fluid circuit 916 can be for heating, and includes first supply line 918, first load 920, and first return line 922. One or more pumps 924 can be included in first process fluid circuit 916. First process fluid circuit 916 can further include fluid lines 926 and valves 928 configured to control flow of process fluid from first process fluid circuit 916 to one or more air-to-fluid heat exchangers 930.

Heating and cooling system 900 also includes second process fluid circuit 932, such as for cooling. Second process fluid circuit 932 includes second supply line 934, second load 936, and second return line 938. Second process fluid circuit 932 can further include one or more pumps 940. The second process fluid circuit 932 can also further include fluid lines 942 and valves 944 configured to control flow of process fluid from the second process fluid circuit 932 to the one or more air-to-fluid heat exchangers 930.

Thermal system 902 can be, for example, a combined heating and cooling system capable of heating, cooling, and simultaneous heating and cooling operations. Thermal system 902 can be, for example, a multi-pipe heating and cooling system such as a four-pipe heating and cooling system. Thermal system 902 circulates a working fluid, such as any suitable refrigerant, to provide the heating, cooling, or simultaneous heating and cooling.

Thermal system 902 includes one or more compressors 904 configured to compress the working fluid. The one or more compressors 904 can be any suitable type of compressor, or combinations thereof. Where the one or more compressors 904 includes multiple compressors, the compressors can be in series, in parallel, or in a combination thereof.

Thermal system 902 includes at least one first heat exchanger 906. Each of the at least one first heat exchanger (s) 906 is configured to exchange heat between the working fluid and a first process fluid of first process fluid circuit 916. Each of the at least one first heat exchanger(s) 906 can receive the first process fluid from the first return line 922, pass the first process fluid through the first heat exchanger 906 so as to exchange heat between the working fluid and the first process fluid, and direct the first process fluid into first supply line 918 to service first load 920.

Thermal system 902 further includes at least one second heat exchanger 908. Each of the at least one second heat exchanger(s) 908 is configured to exchange heat between the working fluid and the second process fluid of second process fluid circuit 932. Each of the at least one second heat exchanger(s) 908 can receive the second process fluid from the second return line 938, pass the first process fluid through the second heat exchanger 908 so as to exchange heat between the working fluid and the second process fluid and direct the first process fluid into second supply line 934 to service second load 936.

Thermal system 902 additionally includes at least one third heat exchanger 910. Each of the at least one third heat exchanger(s) are configured to exchange heat between the working fluid and an ambient environment of said third heat exchanger 910. The third heat exchanger(s) 910 can be configured such that the working fluid can absorb heat or reject heat, based on the ambient conditions and the temperature of the working fluid based when it is provided at third heat exchanger 910.

Thermal system 902 includes one or more expanders 912 disposed along the fluid circuit that the working fluid is circulated through. At least one of the one or more expanders 912 can be included in the flow path of the working fluid from the compressor when the working fluid is circulated through thermal system 902. The expander(s) 912 can include any suitable expander capable of expanding received working fluid, such as, for example, an expansion valve, an expansion plate, an expansion vessel, one or more expansion orifices, combinations thereof, or any other known suitable structure(s) for expanding the working fluid.

A plurality of valves 914 are provided on the fluid lines of thermal system 902. In an embodiment, the valves 914 are configured to control flow through the respective connected fluid lines such that two of the first heat exchanger(s) 906, second heat exchanger(s) 908, and third heat exchanger(s) 910 are included in the flow path for the working fluid and the other of the first heat exchanger(s) 906, second heat exchanger(s) 908, and third heat exchanger(s) 910 are excluded from the flow path for the working fluid. In an embodiment, the valves 914 can be configured to include the first heat exchanger(s) 906 and the second heat exchanger(s) 908 and exclude the third heat exchanger(s) 910 when the thermal system 902 is in a mode where both first load 920 and second load 936 are serviced, such as a combined heating and cooling mode. In an embodiment, the valves 914 can be configured to include the first heat exchanger(s) 906 and the third heat exchanger(s) 910 and exclude the second heat exchanger(s) 908 when the thermal system 902 is in a mode where first load 920 is serviced, such as a heating mode. In an embodiment, the valves 914 can be configured to include the second heat exchanger(s) 908 and the third heat exchanger(s) 910 and exclude the first heat exchanger (s) 906 when the thermal system 902 is in a mode where second load 936 is serviced, such as a cooling mode.

First process fluid circuit 916 is configured to circulate a first process fluid so as to service first load 920. In an embodiment, the first load 920 is a heating load, and the first process fluid circuit 916 is configured such that the first process fluid absorbs heat at first heat exchanger(s) 906 and rejects heat at first load 920 to provide heating at first load 920. First process fluid circuit 916 includes a first supply line 918 configured to convey the first process fluid from the first heat exchanger(s) 906 to the first load 920. The process fluid exchanges heat at the first load 920, and is returned from the first load 920 to the first heat exchanger(s) 906 by way of the first return line 922. One or more pumps 924 can be included in first process fluid circuit 916, for example on first supply line 918 or first return line 922 to drive the circulation of the first process fluid through first process fluid 916.

First process fluid circuit 916 can include fluid lines 926 configured to direct a portion of the first process fluid to at least some of the one or more air-to-fluid heat exchangers 930. The portion of the flow directed to the air-to-fluid heat exchanger(s) 930 can be diverted and controlled by valves 928 provided at suitable positions in first process fluid circuit 916. In the embodiment shown in FIG. 9, the valves 928 and fluid lines 926 are configured such that the first process fluid provided to the air-to-fluid heat exchanger(s) 930 is obtained from and returned to the first supply line 918, however in an alternative embodiment, the valves 928 and fluid line 926 can instead be configured such that the first process fluid provided to the air-to-fluid heat exchanger(s) 930 is obtained from and returned to first return line 922.

One or more air-to-fluid heat exchangers 930 in proximity to the one or more third heat exchangers 910, such that the air-to-fluid heat exchangers 930 can exchange heat between one or both of the first and second process fluids and the ambient environment of at least one of the third heat exchangers 910. The exchange of heat at the air-to-fluid heat exchangers 930 can be, for example, to pre-heat or pre-cool one or both of the first and second process fluids, to defrost said at least one of the third heat exchangers 910, or any other suitable result of such heat exchange as provided herein. In an embodiment, a plurality of the air-to-fluid heat exchangers 930 are provided, with some of the plurality of air-to-fluid heat exchangers 930 configured to receive the first process fluid and others of the plurality of air-to-fluid heat exchangers 930 configured to receive the second process fluid. In an embodiment, the air-to-fluid heat exchangers 930 can be configured to receive either of the first process fluid or the second process fluid.

Second process fluid circuit 932 is configured to circulate a second process fluid so as to service second load 936. In an embodiment, the second load 936 is a cooling load, and the second process fluid circuit 932 is configured such that the second process fluid rejects heat at second heat exchanger(s) 908 and absorbs heat from second load 936 to provide heating at second load 936. Second process fluid circuit 932 includes a second supply line 934 configured to convey the second process fluid from the second heat exchanger(s) 908 to the second load 936. The process fluid exchanges heat at the second load 936, and is returned from the second load 936 to the second heat exchanger(s) 908 by way of the second return line 938. One or more pumps 940 can be included in second process fluid circuit 932, for example on second supply line 934 or second return line 938 to drive the circulation of the second process fluid through second process fluid 932.

Second process fluid circuit 932 can include fluid lines 942 configured to direct a portion of the second process fluid to at least some of the one or more air-to-fluid heat exchangers 930. In an embodiment, said at least some of the one or more air-to-fluid heat exchangers 930 connected to the second process fluid circuit 932 are separate from the one or more air-to-fluid heat exchangers 930 connected to the first process fluid circuit 916. The portion of the flow directed to the air-to-fluid heat exchanger(s) 930 can be diverted and controlled by valves 944 provided at suitable positions in second process fluid circuit 932. In the embodiment shown in FIG. 9, the valves 944 and fluid lines 942 are configured such that the second process fluid provided to the air-to-fluid heat exchanger(s) 930 is obtained from and returned to the second supply line 934, however in an alternative embodiment, the valves 944 and fluid line 942 can instead be configured such that the second process fluid provided to the air-to-fluid heat exchanger(s) 930 is obtained from and returned to second return line 938.

One or more fans 946 can be provided at some or all of the air-to-fluid heat exchangers 930 and/or corresponding third heat exchangers 910. In an embodiment, the fans 946 can be controllable fans having variable speed. In an embodiment, the fans 946 can be reversible such that air can be pulled through or pushed into the third heat exchanger 910 and corresponding air-to-fluid heat exchanger 930. In an embodiment, the reversibility of the fan 946 can allow either of third heat exchanger 910 or air-to-fluid heat exchanger 930 to be the first of the respective heat exchangers 910, 930, that first receives the ambient air being driven or drawn by the fan 946.

Aspects:

It is understood that any of aspects 1-8 can be combined with any of aspects 9-20.

Aspect 1. A method, comprising directing a portion of a flow of process fluid from a hydronic system to a heat exchanger, the heat exchanger configured to exchange heat between the process fluid and an outdoor heat exchanger of a working fluid circuit of a thermal system.

Aspect 2. The method of according to aspect 1, wherein the process fluid rejects heat to the outdoor heat exchanger.

Aspect 3. The method according to aspect 2, further comprising determining a defrosting operation of the heat exchanger, and where the directing the portion of the flow of process fluid from the hydronic system to the heat exchanger is performed when the defrosting operation is determined.

Aspect 4. The method according to aspect 2 or aspect 3, wherein the flow of process fluid, after leaving the heat exchanger, is directed to a cooling load of the hydronic system.

Aspect 5. The method according to aspect 1, wherein the process fluid absorbs heat from the outdoor heat exchanger.

Aspect 6. The method according to aspect 5, wherein the flow of process fluid, after leaving the heat exchanger, is directed to a heating load of the hydronic system.

Aspect 7. The method according to aspect 1, wherein the process fluid is circulated between the thermal system and a second thermal system in a cascade system, and the process fluid rejects heat to the outdoor heat exchanger such that the process fluid is provided to the second thermal system at a target temperature.

Aspect 8. The method according to any of aspects 1-7, wherein the thermal system is selected from the group consisting of a heat pump, a chiller, and a combined heating and cooling apparatus.

Aspect 9. A thermal system and hydronic system, comprising:

a thermal system configured to circulate a working fluid, the thermal system comprising:

a compressor;

a first heat exchanger, configured to exchange heat between the working fluid and an ambient environment;

an expander; and a second heat exchanger configured to exchange heat between the working fluid and a process fluid; and a hydronic system configured to circulate the process fluid, the hydronic system comprising:

a supply line configured to convey the process fluid from the second heat exchanger to a load;

a return line configured to convey the process fluid from the load to the second heat exchanger;

an air-to-fluid heat exchanger configured to exchange heat between the process fluid and the ambient environment at the first heat exchanger; and one or more valves configured to regulate flow of the process fluid to the air-to-fluid heat exchanger.

Aspect 10. The thermal system and hydronic system according to aspect 9, further comprising:

a secondary load supply line configured to convey the process fluid from the air-to-fluid heat exchanger to a secondary load;

a secondary load return line configured to convey the process fluid from the secondary load to the air-to-fluid heat exchanger;

one or more valves configured to regulate flow of the process fluid from the air-to-fluid heat exchanger to the secondary load supply line; and one or more valves configured to regulate flow of the process fluid from the secondary load return line to the air-to-fluid heat exchanger.

Aspect 11. The thermal system and hydronic system according to aspect 10, wherein the secondary load is a cooling load.

Aspect 12. The thermal system and hydronic system according to aspect 10, wherein the secondary load is a heating load.

Aspect 13. The thermal system and hydronic system according to any of aspects 9-12, wherein the load is a second thermal system, the second thermal system in a cascade relationship with the first thermal system.

Aspect 14. The thermal system and hydronic system according to any of aspects 9-13, further comprising a controller configured to determine operation in a defrost mode, and to control at least one of the one or more valves to allow flow of the process fluid to the air-to-fluid heat exchanger.

Aspect 15. The thermal system and hydronic system according to any of aspects 9-14, further comprising a fan configured to direct airflow over the first heat exchanger and the air-to-fluid heat exchanger.

Aspect 16. The thermal system and hydronic system according to aspect 15, wherein the fan is reversible.

Aspect 17. The thermal system and hydronic system according to any of aspects 9-16, wherein the thermal system further comprises a third heat exchanger, the third heat exchanger configured to exchange heat between the working fluid and a second process fluid of a second hydronic system, the second hydronic system configured to circulate the second process fluid to a second load.

Aspect 18. The thermal system and hydronic system according to aspect 17, wherein the second hydronic system is configured to selectively provide the second process fluid to the air-to-fluid heat exchanger.

Aspect 19. The thermal system and hydronic system according to aspect 17, further comprising at least one second air-to-fluid heat exchanger, wherein the second hydronic system is configured to selectively provide the second process fluid to the least one second air-to-fluid heat exchanger.

Aspect 20. The thermal system and hydronic system according to any of aspects 17-19, wherein one of the load and the second load is a heating load, and the other of the load and the second load is a cooling load.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method, comprising:

exchanging heat between a working fluid of a thermal system and a process fluid circulated through a hydronic system in a first heat exchanger, wherein the process fluid circulated though the hydronic system includes supplying the process fluid from the first heat exchanger to a load and returning the process fluid from the load to the first heat exchanger; and directing a portion of a flow of the process fluid from the hydronic system to an air-to-fluid heat exchanger, the air-to-fluid heat exchanger configured to exchange heat between the process fluid and an ambient environment at an outdoor heat exchanger of a working fluid circuit of the thermal system, wherein the thermal system is a reversible thermal system that is configured to add or remove heat from the process fluid, and the directing of the portion of the flow of the process fluid from the hydronic system to the air-to-fluid heat exchanger includes selectively controlling the portion of the flow of the process fluid from either a supply line of the process fluid supplying the process fluid to the load or a return line of the process fluid returning the process fluid to the first heat exchanger, wherein the air-to-fluid heat exchanger is configured in a heat exchange relationship with the outdoor heat exchanger of the working fluid circuit such that during a defrosting operation, heat from the air-to-fluid heat exchanger melts frost buildup on the outdoor heat exchanger.

2. The method of claim 1, wherein the process fluid rejects heat to the outdoor heat exchanger.

3. The method of claim 1, wherein the directing the portion of the flow of process fluid from the hydronic system to the air-to-fluid heat exchanger is performed when the defrosting operation is determined, and further comprising directing airflow from the air-to-fluid heat exchanger to the outdoor heat exchanger to melt the frost buildup on the outdoor heat exchanger.

4. The method of claim 1, wherein the flow of process fluid, after leaving the air-to-fluid heat exchanger, is directed to the load, wherein the load is a cooling load of the hydronic system.

5. The method of claim 1, wherein the process fluid absorbs heat from the outdoor heat exchanger.

6. The method of claim 1, wherein the flow of process fluid, after leaving the air-to-fluid heat exchanger, is directed to the load, wherein the load is a heating load of the hydronic system.

7. The method of claim 1, wherein the process fluid is circulated between the hydronic system and a second hydronic system in a cascade system, and the process fluid rejects heat to the air-to-fluid heat exchanger such that the process fluid is provided to the second hydronic system at a target temperature.

8. The method of claim 1, wherein the thermal system is selected from the group consisting of a heat pump, a chiller, and a combined heating and cooling apparatus.

9. A thermal system and hydronic system, comprising:

a thermal system configured to circulate a working fluid, the thermal system comprising:

a compressor;

an outdoor heat exchanger, configured to exchange heat between the working fluid and an ambient environment;

an expander; and a first heat exchanger configured to exchange heat between the working fluid and a process fluid; and a hydronic system configured to circulate the process fluid, the hydronic system comprising:

a supply line configured to convey the process fluid from the first heat exchanger to a load;

a return line configured to convey the process fluid from the load to the first heat exchanger;

an air-to-fluid heat exchanger configured to exchange heat between the process fluid and the ambient environment at the outdoor heat exchanger; and one or more valves configured to regulate flow of the process fluid to the air-to-fluid heat exchanger, wherein the thermal system and the hydronic system further include a controller configured to control the one or more valves to direct a portion of the flow of the process fluid from the hydronic system to the air-to-fluid heat exchanger by selectively controlling the portion of the flow of the process fluid from either the supply line or the return line, wherein the air-to-fluid heat exchanger is configured in a heat exchange relationship with the outdoor heat exchanger such that during a defrosting operation, heat from the air-to-fluid heat exchanger melts frost buildup on the outdoor heat exchanger, and the thermal system is a reversible thermal system that is configured to add or remove heat from the process fluid.

10. The thermal system and hydronic system of claim 9, further comprising:

a secondary load supply line configured to convey the process fluid from the air-to-fluid heat exchanger to a secondary load;

a secondary load return line configured to convey the process fluid from the secondary load to the air-to-fluid heat exchanger;

one or more valves configured to regulate flow of the process fluid from the air-to-fluid heat exchanger to the secondary load supply line; and one or more valves configured to regulate flow of the process fluid from the secondary load return line to the air-to-fluid heat exchanger.

11. The thermal system and hydronic system of claim 10, wherein the secondary load is a cooling load.

12. The thermal system and hydronic system of claim 10, wherein the secondary load is a heating load.

13. The thermal system and hydronic system of claim 9, wherein the load is a second hydronic system, the second hydronic system in a cascade relationship with the hydronic system.

14. The thermal system and hydronic system of claim 9, wherein the controller is further configured to control at least one of the one or more valves to allow flow of the process fluid to the air-to-fluid heat exchanger and to direct airflow from the air-to-fluid heat exchanger to the outdoor heat exchanger to melt the frost buildup on the outdoor heat exchanger.

15. The thermal system and hydronic system of claim 9, further comprising a fan configured to direct airflow over the outdoor heat exchanger and the air-to-fluid heat exchanger.

16. The thermal system and hydronic system of claim 15, wherein the fan is reversible.

17. The thermal system and hydronic system of claim 9, wherein the thermal system further comprises a third heat exchanger, the third heat exchanger configured to exchange heat between the working fluid and a second process fluid of a second hydronic system, the second hydronic system configured to circulate the second process fluid to a second load.

18. The thermal system and hydronic system of claim 17, wherein the second hydronic system is configured to selectively provide the second process fluid to the air-to-fluid heat exchanger.

19. The thermal system and hydronic system of claim 17, further comprising at least one second air-to-fluid heat exchanger, wherein the second hydronic system is configured to selectively provide the second process fluid to the least one second air-to-fluid heat exchanger.

20. The thermal system and hydronic system of claim 17, wherein one of the load and the second load is a heating load, and the other of the load and the second load is a cooling load.

* * * * *